US007190915B2

(12) United States Patent
Akizuki et al.

(10) Patent No.: US 7,190,915 B2
(45) Date of Patent: Mar. 13, 2007

(54) IMAGE FORMING APPARATUS WITH TIME INTERVAL CONTROL OF FIXING UNIT AND CONTROL METHOD THEREFOR

(75) Inventors: Tomoo Akizuki, Shizuoka (JP); Shinobu Akama, Chiba (JP); Takahiro Endo, Shizuoka (JP); Tohru Saito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 10/994,297

(22) Filed: Nov. 23, 2004

(65) Prior Publication Data

US 2005/0117930 A1 Jun. 2, 2005

(30) Foreign Application Priority Data

Nov. 26, 2003 (JP) ..... 2003-395733

(51) Int. Cl.
*G03G 15/20* (2006.01)

(52) U.S. Cl. ..... 399/69

(58) Field of Classification Search ..... 399/69, 399/67; 219/216
See application file for complete search history.

(56) References Cited

U.S. PATENT DOCUMENTS

| | | | | |
|---|---|---|---|---|
| 4,693,587 | A | 9/1987 | Shigenobu et al. | 355/3 FU |
| 5,306,381 | A * | 4/1994 | Nakazawa et al. | 399/69 |
| 5,420,679 | A | 5/1995 | Goto et al. | 355/285 |
| 5,493,380 | A | 2/1996 | Saitou et al. | 355/290 |
| 5,534,987 | A | 7/1996 | Ohtsuka et al. | |
| 5,701,554 | A | 12/1997 | Tanaka et al. | 399/69 |
| 5,745,833 | A | 4/1998 | Abe et al. | 399/330 |
| 5,801,360 | A * | 9/1998 | Oba et al. | 399/69 |
| 5,915,684 | A | 6/1999 | Nakagawa et al. | 271/110 |
| 6,049,691 | A | 4/2000 | Abe et al. | 399/330 |
| 6,383,628 | B2 | 5/2002 | Abe et al. | 428/334 |
| 6,556,806 | B2 | 4/2003 | Tsuruya et al. | 399/322 |
| 2003/0081964 | A1 | 5/2003 | Shimura et al. | 399/121 |
| 2003/0161651 | A1 | 8/2003 | Tatematsu et al. | 399/69 |
| 2004/0033084 | A1 | 2/2004 | Akizuki et al. | 399/69 |
| 2004/0105693 | A1 | 6/2004 | Akizuki et al. | 399/69 |
| 2004/0197112 | A1 | 10/2004 | Saito et al. | 399/69 |

FOREIGN PATENT DOCUMENTS

| | | | |
|---|---|---|---|
| JP | 04146452 | A * | 5/1992 |
| JP | 05307341 | A * | 11/1993 |
| JP | 6-149102 | | 5/1994 |
| JP | 6-289750 | | 10/1994 |
| JP | 8-146814 | | 6/1996 |
| JP | 8-241011 | | 9/1996 |
| JP | 11-015303 | | 1/1999 |
| JP | 11-194649 | | 7/1999 |
| JP | 3244838 | | 10/2001 |
| JP | 2002-169407 | | 6/2002 |
| JP | 2003-323074 | | 11/2003 |
| JP | 2004-029084 | | 1/2004 |

* cited by examiner

*Primary Examiner*—Susan Lee
(74) *Attorney, Agent, or Firm*—Fitpatrick, Cella, Harper & Scinto

(57) ABSTRACT

An update value for updating a count value is changed in accordance with the time interval of activations of a fixing unit. Every time the fixing unit is activated, the count value is updated in accordance with the update value. The target temperature of the heater of the first rotary body is set in accordance with the updated count value to control the temperature of the fixing unit.

14 Claims, 20 Drawing Sheets

FIG. 6

| INTERMITTENT TIME | 0 SEC (INCLUSIVE) TO 30 SEC (EXCLUSIVE) | 30 SEC (INCLUSIVE) TO 75 SEC (EXCLUSIVE) | 75 SEC (INCLUSIVE) TO 135 SEC (EXCLUSIVE) | 135 SEC (INCLUSIVE) TO 210 SEC (EXCLUSIVE) | 210 SEC (INCLUSIVE) TO 300 SEC (EXCLUSIVE) | 300 SEC OR MORE |
|---|---|---|---|---|---|---|
| COUNTED-UP VALUE IN EACH START-UP | 1.5 | 1.2 | 1.00 | 0.6 | 0.3 | * |

FIG. 7

| COUNT VALUE OF COUNTER | PRESS ROLLER TEMPERATURE (PLAIN SHEET MODE) | PRESS ROLLER TEMPERATURE (OHP MODE) | FIXING TEMPERATURE CONTROL (PLAIN SHEET MODE) | | FIXING TEMPERATURE CONTROL (OHP MODE) | |
|---|---|---|---|---|---|---|
| 0.0～ | ～90°C | ～80°C | 205°C | FIRST TEMPERATURE CONTROL | 175°C | FIRST TEMPERATURE CONTROL |
| 2.0～ | 85～105°C | 75～92°C | 201°C | SECOND TEMPERATURE CONTROL | 171°C | SECOND TEMPERATURE CONTROL |
| 5.0～ | 100～125°C | 87～112°C | 197°C | THIRD TEMPERATURE CONTROL | 167°C | THIRD TEMPERATURE CONTROL |
| 15.0～ | 120～140°C | 107～125°C | 193°C | FOURTH TEMPERATURE CONTROL | 163°C | FOURTH TEMPERATURE CONTROL |
| 25.0～ | 135～155°C | 120～135°C | 189°C | FIFTH TEMPERATURE CONTROL | 159°C | FIFTH TEMPERATURE CONTROL |
| 35.0～ | 150～165°C | 130～145°C | 185°C | SIXTH TEMPERATURE CONTROL | 155°C | SIXTH TEMPERATURE CONTROL |
| 42.0～ | 160°C～ | 140°C～ | 181°C | SEVENTH TEMPERATURE CONTROL | 151°C | SEVENTH TEMPERATURE CONTROL |

700 701

FIG. 8A

○CONTINUOUS PRINTING

| | NUMBER OF PRINTED SHEETS | COUNT VALUE OF COUNTER | PRESS ROLLER TEMPERATURE | TEMPERATURE CONTROL |
|---|---|---|---|---|
| PLAIN SHEET | 0 | 0 | 26°C | FIRST TEMPERATURE CONTROL |
| | 100 | 10 | 111°C | THIRD TEMPERATURE CONTROL |
| | 200 | 20 | 131°C | FOURTH TEMPERATURE CONTROL |
| | 300 | 25 | 141°C | FIFTH TEMPERATURE CONTROL |
| | 400 | 25 | 142°C | FIFTH TEMPERATURE CONTROL |
| OHP | 0 | 26.5 | 124°C | FIFTH TEMPERATURE CONTROL |
| | 5 | 29 | 127°C | FIFTH TEMPERATURE CONTROL |
| | 10 | 31.5 | 130°C | FIFTH TEMPERATURE CONTROL |

FIG. 8B

○INTERMITTENT PRINTING

| | NUMBER OF PRINTED SHEETS | COUNT VALUE OF COUNTER | PRESS ROLLER TEMPERATURE | TEMPERATURE CONTROL |
|---|---|---|---|---|
| PLAIN SHEET | 0 | 0 | 26°C | FIRST TEMPERATURE CONTROL |
| | 100 | 23.5 | 137°C | FOURTH TEMPERATURE CONTROL |
| | 200 | 39.5 | 158°C | SIXTH TEMPERATURE CONTROL |
| | 300 | 50 | 163°C | SEVENTH TEMPERATURE CONTROL |
| | 400 | 50 | 167°C | SEVENTH TEMPERATURE CONTROL |
| OHP | 0 | 50 | 146°C | SEVENTH TEMPERATURE CONTROL |
| | 5 | 50 | 147°C | SEVENTH TEMPERATURE CONTROL |
| | 10 | 50 | 146°C | SEVENTH TEMPERATURE CONTROL |

FIG. 9

| | PLAIN SHEET | | | | OHP | | |
|---|---|---|---|---|---|---|---|
| | GLOSS | | FIXATION | GENERATION OF HOT OFFSET | TRANSPARENCY | | GENERATION OF WINDING |
| | AVERAGE VALUE | VARIATION WIDTH | WORST VALUE | | AVERAGE VALUE | VARIATION WIDTH | |
| CONTINUOUS PRINTING | 15 | 6 | 9.50% | NONE | 81 | 3 | NONE |
| INTERMITTENT PRINTING | 16 | 6 | 8.50% | NONE | 81 | 3 | NONE |

○CONTINUOUS PRINTING

FIG. 10A

| | NUMBER OF PRINTED SHEETS | CONTROL NUMBER OF SHEETS | PRESS ROLLER TEMPERATURE | TEMPERATURE CONTROL |
|---|---|---|---|---|
| PLAIN SHEET | 0 | 0 | 26°C | FIRST TEMPERATURE CONTROL |
| | 100 | 100 | 112°C | THIRD TEMPERATURE CONTROL |
| | 200 | 200 | 132°C | FOURTH TEMPERATURE CONTROL |
| | 300 | 250 | 141°C | FIFTH TEMPERATURE CONTROL |
| | 400 | 250 | 142°C | FIFTH TEMPERATURE CONTROL |
| OHP | 0 | 250 | 124°C | FIFTH TEMPERATURE CONTROL |
| | 5 | 250 | 127°C | FIFTH TEMPERATURE CONTROL |
| | 10 | 250 | 130°C | FIFTH TEMPERATURE CONTROL |

○INTERMITTENT PRINTING

FIG. 10B

| | NUMBER OF PRINTED SHEETS | CONTROL NUMBER OF SHEETS | PRESS ROLLER TEMPERATURE | TEMPERATURE CONTROL |
|---|---|---|---|---|
| PLAIN SHEET | 0 | 0 | 26°C | FIRST TEMPERATURE CONTROL |
| | 100 | 235 | 138°C | FOURTH TEMPERATURE CONTROL |
| | 200 | 250 | 158°C | FIFTH TEMPERATURE CONTROL |
| | 300 | 250 | 166°C | FIFTH TEMPERATURE CONTROL |
| | 400 | 250 | 167°C | FIFTH TEMPERATURE CONTROL |
| OHP | 0 | 250 | 147°C | FIFTH TEMPERATURE CONTROL |
| | 5 | 250 | 150°C | FIFTH TEMPERATURE CONTROL |
| | 10 | 250 | – | FIFTH TEMPERATURE CONTROL |

1000

FIG. 11

| | PLAIN SHEET | | | | OHP | | |
|---|---|---|---|---|---|---|---|
| | GLOSS | | FIXATION | GENERATION OF HOT OFFSET | TRANSPARENCY | | GENERATION OF WINDING |
| | AVERAGE VALUE | VARIATION WIDTH | WORST VALUE | | AVERAGE VALUE | VARIATION WIDTH | |
| CONTINUOUS PRINTING | 15 | 6 | 9.50% | NONE | 81 | 3 | NONE |
| INTERMITTENT PRINTING | 18 | 12 | 5.00% | GENERATED | 83 | 4 | GENERATED |

FIG. 12A

○CONTINUOUS PRINTING

| | NUMBER OF PRINTED SHEETS | CONTROL NUMBER OF SHEETS | PRESS ROLLER TEMPERATURE | TEMPERATURE CONTROL |
|---|---|---|---|---|
| PLAIN SHEET | 0 | 0 | 26°C | FIRST TEMPERATURE CONTROL |
| | 100 | 100 | 112°C | THIRD TEMPERATURE CONTROL |
| | 200 | 200 | 131°C | FOURTH TEMPERATURE CONTROL |
| | 300 | 300 | 139°C | FIFTH TEMPERATURE CONTROL |
| | 400 | 400 | 140°C | SIXTH TEMPERATURE CONTROL |
| OHP | 0 | 415 | 122°C | SIXTH TEMPERATURE CONTROL |
| | 5 | 440 | 124°C | SEVENTH TEMPERATURE CONTROL |
| | 10 | 465 | 125°C | SEVENTH TEMPERATURE CONTROL |

1200

FIG. 12B

○INTERMITTENT PRINTING

| | NUMBER OF PRINTED SHEETS | CONTROL NUMBER OF SHEETS | PRESS ROLLER TEMPERATURE | TEMPERATURE CONTROL |
|---|---|---|---|---|
| PLAIN SHEET | 0 | 0 | 26°C | FIRST TEMPERATURE CONTROL |
| | 100 | 235 | 138°C | FOURTH TEMPERATURE CONTROL |
| | 200 | 395 | 158°C | SIXTH TEMPERATURE CONTROL |
| | 300 | 500 | 165°C | SEVENTH TEMPERATURE CONTROL |
| | 400 | 500 | 168°C | SEVENTH TEMPERATURE CONTROL |
| OHP | 0 | 500 | 144°C | SEVENTH TEMPERATURE CONTROL |
| | 5 | 500 | 146°C | SEVENTH TEMPERATURE CONTROL |
| | 10 | 500 | 147°C | SEVENTH TEMPERATURE CONTROL |

FIG. 13

| | PLAIN SHEET | | | | OHP | | |
|---|---|---|---|---|---|---|---|
| | GLOSS | | FIXATION | GENERATION OF HOT OFFSET | TRANSPARENCY | | GENERATION OF WINDING |
| | AVERAGE VALUE | VARIATION WIDTH | WORST VALUE | | AVERAGE VALUE | VARIATION WIDTH | |
| CONTINUOUS PRINTING | 13 | 10 | 15.00% | NONE | 74 | 2 | NONE |
| INTERMITTENT PRINTING | 16 | 6 | 8.50% | NONE | 81 | 3 | NONE |

FIG. 14

| TEMPERATURE DETECTED BY SUB-THERMISTOR | VALUE TO BE SET TO COUNTER |
|---|---|
| ROOM TEMPERATURE | 0.0 |
| 35°C~ | 2.0 |
| 45°C~ | 4.0 |
| 55°C~ | 6.2 |
| 65°C~ | 9.0 |
| 75°C~ | 13.0 |
| 85°C~ | 16.0 |
| 95°C~ | 20.0 |
| 105°C~ | 25.0 |
| 115°C~ | 30.0 |
| 125°C~ | 35.0 |
| 130°C~ | 40.0 |

IMAGE FORMING APPARATUS WITH TIME INTERVAL CONTROL OF FIXING UNIT AND CONTROL METHOD THEREFOR

FIELD OF THE INVENTION

The present invention relates to an image forming apparatus which forms an image by electrophotography and fixes the formed image on a recording medium, and a control method therefor.

BACKGROUND OF THE INVENTION

Image forming apparatuses such as a printer and copying machine have recently been developed for color printing. As a fixing unit used in such a color image forming apparatus, a heat roller type fixing unit having an elastic layer on a fixing member is known well.

The heat roller type fixing unit having an elastic layer suffers a large heat capacity of the heat roller itself, and thus a long time (warm-up time) necessary to raise the fixing roller to a temperature suitable for fixing a toner image. In addition, the cost of the fixing unit rises.

As a fixing unit having a short warm-up time, a belt fixing type fixing unit often used in a monochrome image forming apparatus is known well. FIG. 19 depicts a view showing an example of a belt fixing unit 201.

A fixing belt unit 202 is an assembly having a heater holder 207 with an almost semicircular troughed cross section, a fixing heater 204 which is fixed on the lower surface of the heater holder 207 along the longitudinal direction (direction perpendicular to the sheet surface of FIG. 19) of the heater holder, and a fixing belt 203 of an endless belt-like (cylindrical) thin layer which is loosely fitted on the heater holder 207 having the fixing heater.

Reference numeral 205 denotes an elastic press roller whose core is freely rotatably born at its two ends between the side plates of the fixing unit 201.

In the fixing belt unit 202, the fixing heater 204 is arranged above the elastic press roller 205 so that the fixing heater 204 faces down and becomes parallel to the press roller 205. The two ends of the heater holder 207 are pressed down by a biasing means (not shown) at a predetermined press force. The lower surface of the fixing heater 204 is pressed against the elastic force of the press roller 205 to the upper surface of the elastic press roller 205 via the fixing belt 203, forming a fixing nip 206 with a predetermined width.

The elastic press roller 205 is driven to rotate by a driving mechanism (not shown) at a predetermined peripheral speed in a direction indicated by an arrow. By rotational driving of the elastic press roller 205, the rotational force acts on the fixing belt 203 by the frictional force between the elastic press roller 205 and the outer surface of the fixing belt 203 at the fixing nip 206. While the fixing belt 203 slides with its inner surface in tight contact with the lower surface of the fixing heater 204 at the fixing nip 206, the fixing belt 203 is driven to rotate around the heater holder 207 at a peripheral speed substantially corresponding to that of the elastic press roller 205 in a direction indicated by an arrow.

The fixing belt 203 is an endless belt of a heat-resistant resin about 50 μm thick, and its surface is covered with a 10-μm thick mold release layer (coating layer of a fluoroplastic or the like). In order to reduce the heat capacity of the fixing belt 203, the fixing belt 203 does not use any elastic layer.

The fixing heater 204 is prepared by forming a resistance heating element on a ceramic substrate. A temperature detection unit 209 abuts against the back surface of the fixing heater 204, and detects the temperature of the fixing heater 204. In accordance with the detected temperature, a control unit (not shown) controls power supply to the fixing heater 204 so as to set the temperature of the fixing heater 204 to a desired one.

The elastic press roller 205 is driven to rotate, the fixing belt 203 is driven to rotate along with this, and the fixing heater 204 reaches a predetermined temperature. In this temperature-controlled state, a print medium P bearing an unfixed toner image t is introduced between the fixing belt 203 and the elastic press roller 205 at the fixing nip 206. The unfixed toner image bearing surface of the print medium P is brought into tight contact with the outer surface of the fixing belt 203, and the print medium P is clamped and conveyed together with the fixing belt 203 through the fixing nip 206. During clamping and conveyance, heat of the fixing heater 204 is applied to the print medium P via the fixing belt 203, and the pressure of the fixing nip 206 is also applied. Accordingly, the unfixed toner image t is fixed as a permanently fixed image onto the print medium P by the heat and pressure. The print medium P passes through the fixing nip 206, self-strips from the surface of the fixing belt 203, and is discharged.

In the fixing unit 201 having this configuration, the heat capacity of the fixing belt 203 is very small, and the fixing nip 206 can reach a toner image fixable temperature within a short time after the fixing heater 204 is powered.

However, when the belt fixing unit 201 using the fixing belt 203 having no elastic layer is adopted as a fixing unit for a color image forming apparatus, the surface of the fixing belt 203 cannot follow undulations on the surface of the print medium P, undulations caused by the presence/absence of a toner layer, undulations of the toner layer itself, and the like because no elastic layer is formed on the fixing belt 203 serving as a fixing member. This results in a difference in heat amount applied from the fixing belt 203 between the recess and the projection. That is, the applied heat amount is large at the projection in good contact with the fixing belt 203 because heat conducts well from the fixing belt 203, but is small at the recess in poor contact with the fixing belt 203 because heat does not conduct well from the fixing belt 203 in comparison with the projection. Since the heat amount applied to the toner layer changes between the recess and projection of the toner layer, the toner fusing state becomes nonuniform and appears as gloss nonuniformity, adversing a fixed image.

Especially, a color image is formed by superposing and mixing toner images of a plurality of colors, and thus the toner layer is undulated more greatly than a monochrome image. When the fixing belt 203 does not have any elastic layer, gloss nonuniformity of a fixed image becomes more conspicuous, degrading the image quality. When the print medium P is an OHP sheet and an image is projected after fixing it, light scatters owing to a microscopically nonuniform surface of the fixed image, decreasing the transparency.

The fixing belt 203 may be coated with silicone oil or the like so as to sufficiently uniformly conduct heat to the fixing belt 203 having no elastic layer and the undulated portion of the print medium P or unfixed toner image t. This method increases the cost, and the fixed image and print medium P become oily.

To prevent these problems, there has been proposed a fixing unit which forms a low-cost color on-demand fixing unit by using a fixing belt with an elastic layer for a belt fixing unit (see Japanese Patent Laid-Open No. 11-15303).

FIG. 20 depicts a schematic view showing the schematic configuration of a belt fixing unit using as a fixing member a fixing belt 203 with an elastic layer. The same reference numerals as those in the device of FIG. 19 denote the same structuring members and parts, and a repetitive description thereof will be omitted.

In a heat roller fixing type fixing unit, the heat capacities of the heat roller and press roller 205 are large, and the temperature is simply kept at a predetermined value. On the contrary, a film or belt heating type fixing unit reduces the heat capacity in order to ensure an on-demand characteristic, and poses the following problems. More specifically, in the film or belt heating type fixing unit, the heat amount applied to the print medium P greatly changes depending on the temperature of the press roller 205, and the temperature of the press roller 205 greatly varies depending on the using state. It is therefore difficult to keep the heat amount applied to the print medium P uniform.

At this time, it is difficult to obtain good fixation and a uniform gloss value regardless of the using state. Depending on conditions, not only the gloss value greatly varies upon great variations in the temperature of the press roller 205, but also an image failure such as a fixing failure or hot offset occurs. Further, the print medium P may be wound around the fixing unit.

To solve these problems, a belt fixing type fixing unit which is often used in a monochrome image forming apparatus and does not have any elastic layer makes the following proposals.

As the first example, temperature detection units (not shown) are arranged for not only the heater but also the press roller 205, and detect the temperatures of both the fixing heater 204 and press roller 205. The heat accumulation amount in the press roller 205 is considered on occasion, and the fixing temperature is so determined as to maintain the heat amount applied to the print medium P at the fixing nip 206 at a predetermined reference value (see Japanese Patent Laid-Open No. 6-149102).

As the second example, the temperature detection unit 209 which abuts against the back surface of the fixing heater 204 is used. The fixing temperature is determined on the basis of a temperature detected by the temperature detection unit 209 before the start of energization and a change in temperature detected by the temperature detection unit 209 after the end of energization to the fixing heater 204 (see Japanese Patent Laid-Open Nos. 6-289750 and 11-194649 and Japanese Patent No. 3,244,838).

As the third example, there is proposed a method utilizing sheet count control in which the fixing temperature is determined on the basis of the number of fixed sheets. This method is characterized by switching the fixing temperature as the number of fixed sheets increases. There are proposed a method of determining an apparent number of sheets in accordance with a temperature detected by the temperature detection unit 209 immediately before printing, a method of counting an apparent number of sheets in intermittent printing more than in continuous printing, and a method of counting an apparent number of sheets in a different unit in accordance with the time till reception of the next print signal after energization to the fixing heater 204 stops or power is reduced (see Japanese Patent Laid-Open No. 2002-169407).

However, the following problems occur when the fixing temperature determination method used in a monochrome image forming apparatus is applied to a color image forming apparatus.

These problems will be explained.

For example, according to Japanese Patent Laid-Open No. 6-149102, a temperature detection unit arranged for the press roller 205 leads to a bulky apparatus and high cost. When the temperature detection unit 209 contacts the press roller 205, it contaminates the press roller 205 with toner, paper dust, or the like, and contaminates the print medium P when the print medium P passes. The temperature detection unit 209 damages the press roller 205 on standby, and forms a trace corresponding to the damage of the press roller 205 on an image in double-sided printing.

For example, according to Japanese Patent Laid-Open Nos. 6-289750 and 11-194649 and Japanese Patent No. 3,244,838, the fixing belt has an elastic layer, and the heat capacity of the fixing belt is large. Thus, the temperature difference between a temperature detected by a thermistor on the back surface of the heater and the temperature of the press roller 205 may become large after the end of energization to the fixing unit. The temperature of the press roller cannot be detected because the relaxation time until the temperature difference between a temperature detected by the thermistor on the back surface of the heater and the temperature of the press roller 205 after the end of energization to the fixing unit relaxes and these temperatures become almost equal to each other is much longer than that of a fixing unit using a fixing belt having no elastic layer. Since the temperature of the press roller cannot be detected, this method cannot be utilized in a color image fixing unit of, e.g., an electromagnetic induction heating type which is not equipped with any temperature detection unit near the fixing nip, e.g., on the back surface of the fixing heater. The color image fixing unit requires a means for completely indirectly predicting the temperature of the press roller.

For example, Japanese Patent Laid-Open No. 2002-169407 has the following problems in determining fixing temperature control on the basis of the number of fixed sheets.

A color image fixing unit generally uses a large amount (M/S) of toner to be fixed, and the fixing temperature is higher than that of a monochrome image. Also in a monochrome image forming apparatus, the fixing temperature rises as the speed increases.

For a high fixing temperature, power applied to start fixing must be increased to ensure the on-demand characteristic, and the heat amount applied to the press roller at the start of fixing more greatly increases. That is, the temperature of the press roller at the start more greatly rises. In a fixing unit used in the above-described color image forming apparatus, the fixing belt has an elastic layer, and the heat capacity of the fixing belt is large. Power applied to start fixing must be set large for a color image, and the temperature of the press roller further rises because the nip is kept heated until the fixing belt reaches a predetermined temperature.

After the start of feeding a transfer medium P, the transfer medium P intermittently deprives the press roller of heat, and the temperature of the press roller stabilizes at an almost constant temperature. When the speed of the fixing unit increases, an amount by which a print medium passes through the fixing unit per unit time increases. An amount by which the print medium deprives the press roller of heat also increases, and the temperature of the press roller hardly rises in continuous printing.

In other words, when a color fixing unit is used or higher-speed printing is done, the temperature rise rate of the press roller in continuous printing becomes much lower than that of the press roller at the start.

If the temperature rise rate of the press roller greatly changes in this way, the saturation temperature of the press roller after printing continues becomes much higher in intermittent printing than in continuous printing. When the printing speed becomes higher, the temperature of the press roller hardly rises and stays at a relatively low temperature in continuous printing, but greatly rises in intermittent printing.

In the use of the technique disclosed in Japanese Patent Laid-Open No. 2002-169407, the saturation temperature upon printing of a large number of sheets is different between continuous printing and intermittent printing in sheet count control, and thus the temperature of the press roller cannot be detected at high precision. That is, sheet count control which satisfies both continuous printing and intermittent printing cannot be achieved.

In Japanese Patent Laid-Open No. 2002-169407, a belt having no elastic layer is used, and the temperature of the press roller is measured by a thermistor which abuts against the fixing heater. On the contrary, in the use of a fixing belt having an elastic layer, the time until a temperature detected by the thermistor becomes equal to the temperature of the press roller is very long, and the temperature of the press roller cannot be detected in real time. Also, the temperature of the press roller cannot be detected in a color image fixing unit of, e.g., an electromagnetic induction heating type which is not equipped with any temperature detection unit near the fixing nip, e.g., on the back surface of the fixing heater. In this case, the temperature of the press roller cannot be obtained upon power-on/off, and no appropriate control temperature can be selected.

As described above, it is difficult for the conventional methods to obtain stable fixation and a uniform gloss value. Depending on conditions, the gloss value greatly varies, and an image failure such as a fixing failure or hot offset occurs. The conventional methods also suffer a technical problem in which the print medium P is wound around the fixing unit.

SUMMARY OF THE INVENTION

The present invention has been made to overcome the conventional drawbacks, and has as its features to provide an image forming apparatus which can predict the temperature of a press roller at high precision and controls the temperature in accordance with the temperature of the press roller even when the fixing unit is a color fixing unit having a large heat capacity or when the speed is increased regardless of monochrome or color printing, and a control method therefor.

According to an aspect of the present invention, there is provided with an image forming apparatus having a fixing unit for heating and fixing an image on a print medium, the apparatus, comprising: a first rotary body arranged in the fixing unit and configured to have a heating source; a second rotary body configured to clamp a print medium together with the first rotary body; time interval measurement means for measuring a time interval between activations of the fixing unit; determination means for determining an update value corresponding to the number of activations of the fixing unit in accordance with the time interval measured by the time interval measurement means; a counter configured to update a count value on the basis of the update value determined by the determination means; and temperature control means for controlling a temperature of the first rotary body on the basis of the count value updated by the update means.

According to an aspect of the present invention, there is provided with a control method for an image forming apparatus having a fixing unit for heating and fixing an image on a print medium, the method, comprising: a time interval measurement step of measuring a time interval between activations of the fixing unit having a first rotary body with a heating source and a second rotary body for clamping the print medium together with the first rotary body; a determination step of determining an update value corresponding to the number of activations of the fixing unit in accordance with the time interval measured in the time interval measurement step; an update step of updating a count value on the basis of the update value determined in the determination step; and a temperature control step of controlling a temperature of the first rotary body on the basis of the count value updated in the update step.

Other features, objects and advantages of the present invention will be apparent from the following description when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 6 depicts a table for explaining the relationship between the intermittent time and a value counted up every start-up in an intermittent printing;

FIG. 7 depicts a table showing, in accordance with the type of print medium (print sheet), the temperature of a press roller and fixing temperature control which correspond to the count value;

FIGS. 8A and 8B depict tables showing a count, the temperature of the press roller, and the measurement result of temperature control selected by the fixing unit for each number of printed sheets in continuous printing and intermittent printing;

FIG. 9 depicts a table showing an example of image evaluation results in continuous printing and intermittent printing;

FIGS. 10A and 10B depict tables for explaining results in the use of control operations assuming continuous printing and intermittent printing;

FIG. 11 depicts a table showing an example of results in the use of control (control A) assuming continuous printing and intermittent printing;

FIGS. 12A and 12B depict tables for explaining results in the use of control operations assuming continuous printing and intermittent printing;

FIG. 13 depicts a table for explaining an example of results in the use of control (control B) assuming intermittent printing;

FIG. 14 depicts a table for explaining the relationship between a temperature detected by a sub-thermistor and an apparent start-up count;

DETAILED DESCRIPTION OF THE PREFERRED EMBODIMENTS

Preferred embodiments of the present invention will be described in detail below with reference to the accompanying drawings. The sizes, materials, shapes, and relative arrangement of building components described in the embodiments should be properly changed in accordance with the configuration of an apparatus to which the present invention is applied and various conditions, and do not limit the scope of the present invention to the following embodiments.

[First Embodiment]

[Description of Image Forming Apparatus]

Figure 1:
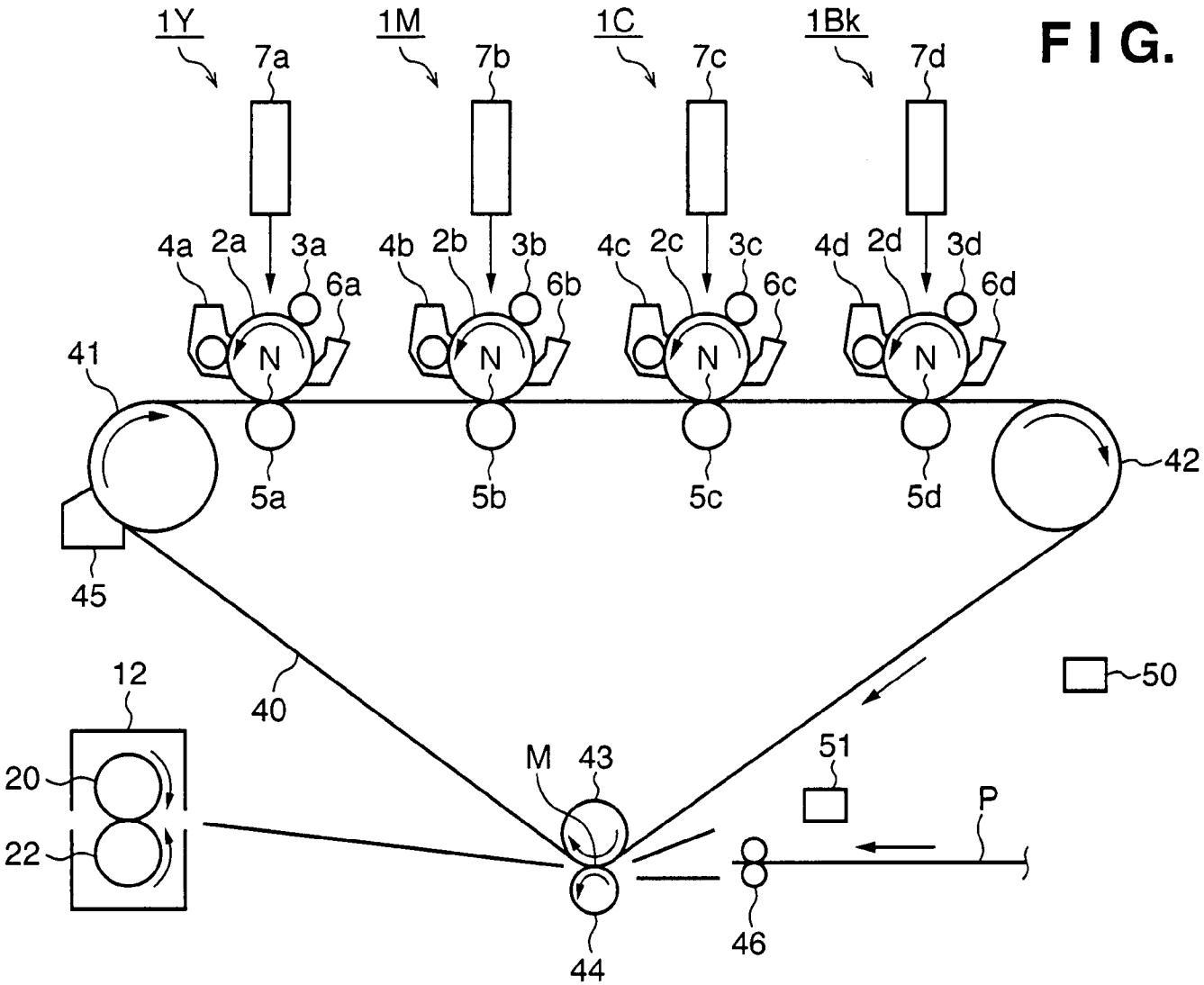
FIG. 1 depicts a view showing the schematic configuration of the printing part of a color image forming apparatus according to the first embodiment of the present invention.

FIG. 1 depicts a schematic view for explaining the configuration of the printing part of a color image forming apparatus according to the first embodiment of the present invention. The image forming apparatus according to the first embodiment is an electrophotographic tandem type full-color printer.

The image forming apparatus comprises four image forming parts (image forming units): an image forming part 1Y which forms a yellow image, an image forming part 1M which forms a magenta image, an image forming part 1C which forms a cyan image, and an image forming part 1Bk which forms a black image. These four image forming parts are arrayed in line at predetermined intervals.

The image forming parts 1Y, 1M, 1C, and 1Bk respectively have photosensitive drums 2*a*, 2*b*, 2*c*, and 2*d*. The photosensitive drums 2*a*, 2*b*, 2*c*, and 2*d* are surrounded by charging rollers 3*a*, 3*b*, 3*c*, and 3*d*, developing devices 4*a*, 4*b*, 4*c*, and 4*d*, transfer rollers 5*a*, 5*b*, 5*c*, and 5*d*, and drum cleaning devices 6*a*, 6*b*, 6*c*, and 6*d*, respectively. Exposure devices 7*a*, 7*b*, 7*c*, and 7*d* are arranged above the spaces between the charging rollers 3*a*, 3*b*, 3*c*, and 3*d* and the developing devices 4*a*, 4*b*, 4*c*, and 4*d*, respectively. The developing devices 4*a*, 4*b*, 4*c*, and 4*d* respectively store yellow toner, magenta toner, cyan toner, and black toner.

An endless belt-like intermediate transfer member 40 serving as a transfer medium abuts against primary transfer portions N of the photosensitive drums 2*a*, 2*b*, 2*c*, and 2*d* in the image forming parts 1Y, 1M, 1C, and 1Bk. The intermediate transfer belt 40 is looped between a driving roller 41, a support roller 42, and a secondary transfer counter roller 43, and rotated (moved) in a direction indicated by an arrow (clockwise in FIG. 1) by rotational driving of the driving roller 41.

The transfer rollers 5*a*, 5*b*, 5*c*, and 5*d* for primary transfer respectively abut against the photosensitive drums 2*a*, 2*b*, 2*c*, and 2*d* via the intermediate transfer belt 40 at the corresponding primary transfer nips N. The secondary transfer counter roller 43 abuts against a secondary transfer roller 44 via the intermediate transfer belt 40, and forms a secondary transfer portion M. The secondary transfer roller 44 is so set as to freely come into contact with or move apart from the intermediate transfer belt 40. A belt cleaning device 45 which removes and recovers toner remaining after transfer on the surface of the intermediate transfer belt 40 is set near the driving roller 41 outside the intermediate transfer belt 40. A fixing unit 12 is set on the downstream side of the secondary transfer portion M in the convey direction of a print medium P. The image forming apparatus further incorporates an environmental sensor 50 and medium sensor 51.

When an image forming operation start signal (print start signal) is generated, the photosensitive drums 2*a*, 2*b*, 2*c*, and 2*d* of the image forming parts 1Y, 1M, 1C, and 1Bk that are driven to rotate at predetermined process speeds are uniformly charged (negatively in the first embodiment) by the charging rollers 3*a*, 3*b*, 3*c*, and 3*d*, respectively. The exposure devices 7*a*, 7*b*, 7*c*, and 7*d* respectively convert color-separated input image signals into optical signals by laser output portions (not shown), and scan and expose the charged photosensitive drums 2*a*, 2*b*, 2*c*, and 2*d* to laser beams serving as the converted optical signals, thereby respectively forming electrostatic latent images.

The electrostatic latent image is visualized as a developed image by electrostatically applying yellow toner onto the photosensitive drum 2*a* bearing the electrostatic latent image in accordance with the charging potential of the photosensitive surface from the developing device 4*a* to which a developing bias of the same polarity as the charging polarity (negative polarity) of the photosensitive drum 2*a* is applied. At the primary transfer portion N, the yellow toner image is primarily transferred onto the rotating intermediate transfer belt 40 by the transfer roller 5*a* to which a primary transfer bias (polarity (positive polarity) opposite to that of toner) is applied. The intermediate transfer belt 40 on which the yellow toner image is transferred is moved to the image forming part 1M. Also in the image forming part 1M, a magenta toner image formed on the photosensitive drum 2*b* similarly to the yellow toner image is transferred over the yellow toner image on the intermediate transfer belt 40 at the primary transfer portion N. Similarly, cyan and blank toner images formed on the photosensitive drums 2*c* and 2*d* of the image forming parts 1C and 1Bk are sequentially transferred at the corresponding primary transfer portions N over the yellow and magenta toner images superposed and transferred on the intermediate transfer belt 40, thereby forming a full-color toner image on the intermediate transfer belt 40.

A print medium (transfer medium) P is conveyed by register rollers 46 to the secondary transfer portion M in synchronism with a timing at which the distal (leading) end of the full-color toner image on the intermediate transfer belt 40 is moved to the secondary transfer portion M. The full-color toner image is secondarily transferred at once onto the print medium P by the secondary transfer roller 44 to which a secondary transfer bias (polarity (positive polarity) opposite to that of toner) is applied. The print medium P bearing the full-color toner image is conveyed to the fixing unit 12. The full-color toner image is heated and pressed at a fixing nip between a fixing belt 20 and a press roller 22, fusing toners and fixing the color image onto the surface of the print medium P. The color image is discharged outside the apparatus as an output image from the image forming apparatus. In this manner, a series of image forming operations end.

The image forming apparatus incorporates the environmental sensor 50, and the charging bias, developing bias, primary transfer bias, secondary transfer bias, and fixing conditions can be changed in accordance with the environment (temperature and humidity) inside the image forming apparatus. An output from the environmental sensor 50 is used for adjusting the density of a toner image formed on the print medium P and achieving optimal transfer and fixing conditions. The image forming apparatus also incorporates the medium sensor 51, and the transfer bias and fixing conditions can be changed in accordance with the type of print medium by determining the type of print medium P on the basis of a signal from the medium sensor 51. An output from the medium sensor 51 is used for achieving transfer and fixing conditions optimal for the print medium P.

In primary transfer, primary transfer toners remaining on the photosensitive drums 2*a*, 2*b*, 2*c*, and 2*d* are removed and recovered by the drum cleaning devices 6*a*, 6*b*, 6*c*, and 6*d*. Secondary transfer toner remaining on the intermediate transfer belt 40 after secondary transfer is removed and recovered by the belt cleaning device 45.

[Description of Fixing Unit]

Figure 2:
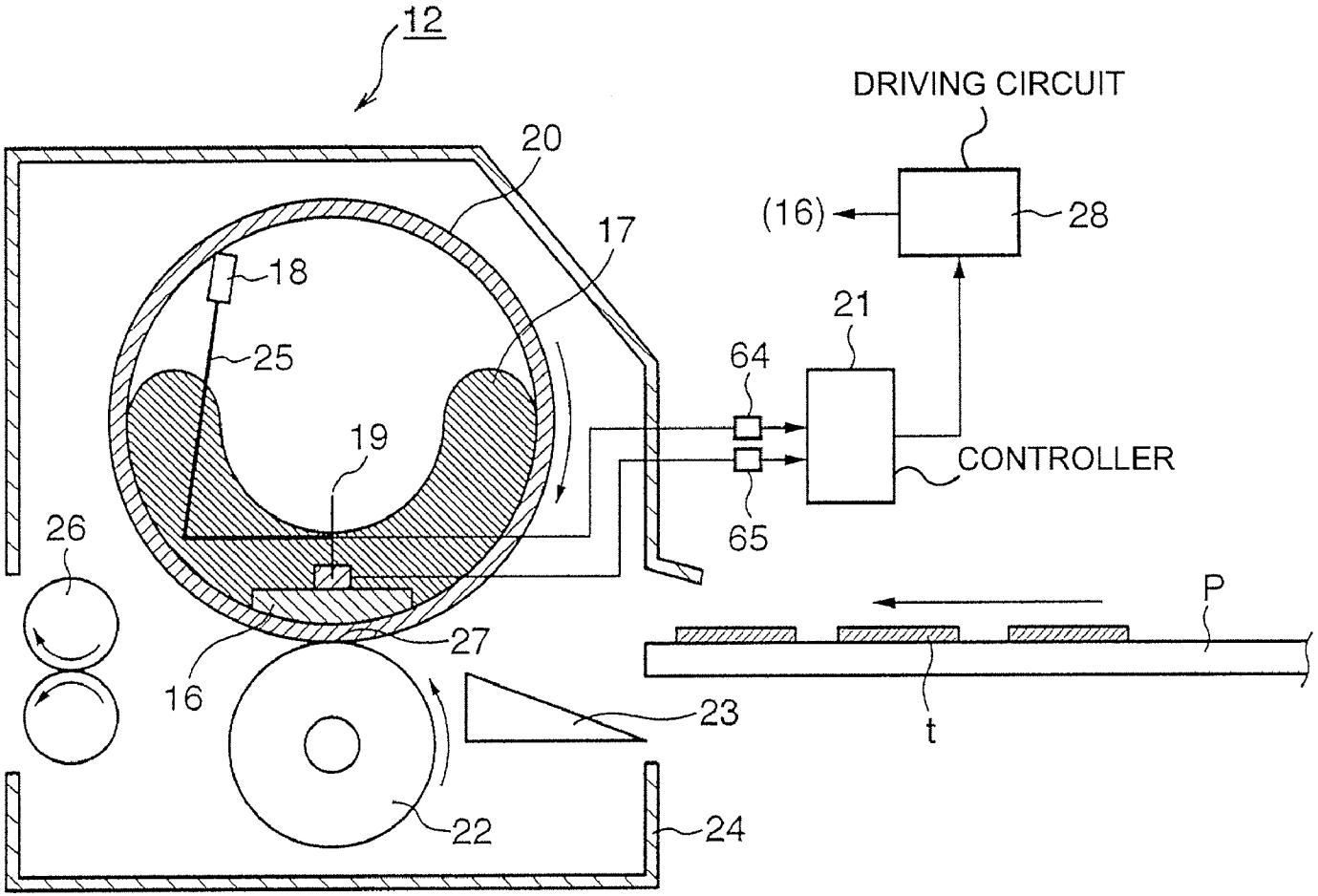
FIG. 2 depicts a schematic sectional view showing a fixing unit according to the first embodiment of the present invention.

FIG. 2 is a schematic view showing the schematic configuration of the fixing unit 12 of the image forming apparatus according to the first embodiment of the present invention. The fixing unit 12 according to the first embodiment is a heating device of a fixing belt heating type and press rotary body driving type (tensionless type).

(1) Overall Configuration of Fixing Unit 12

The fixing belt 20 is a first rotary body (first fixing member), and is a cylindrical (endless belt-like or sleeve like) member obtained by forming an elastic layer on a belt-like member. The fixing belt 20 will be described in detail later. The press roller 22 is a second rotary body (second fixing member). Reference numeral 17 denotes a heater holder which is a heating element holding member, has an almost semicircular troughed cross section, and has heat resistance and rigidity. Reference numeral 16 denotes a fixing heater serving as a heating element (heat source) which is arranged on the back surface of the heater holder 17 along the longitudinal direction of the holder 17 (see FIG. 3). The fixing belt 20 is loosely fitted outer the heater holder 17. In the first embodiment, the fixing heater 16 is a ceramic heater (to be described later).

The heater holder 17 is formed from a liquid crystal polymer resin with high heat resistance, holds the fixing heater 16, and guides the fixing belt 20. In the first embodiment, the liquid crystal polymer is Zenite 7755 (trademark) available from Du Pont. The maximum usable temperature of Zenite 7755 is about 270° C.

The press roller 22 is prepared by forming a silicone rubber layer about 3 mm thick on a stainless steel core by injection molding and forming a PFA resin tube about 40 μm thick on the silicone rubber layer. The core of the press roller 22 is freely rotatably born and held at its two ends between the back and front side plates (not shown) of an apparatus frame 24. A fixing belt unit formed from the fixing heater 16, heater holder 17, fixing belt 20, and the like is arranged above the press roller 22 so that the fixing belt unit becomes parallel to the press roller 22 while the heater 16 faces down. The two ends of the heater holder 17 are biased by a press mechanism (not shown) along the axis of the press roller 22 at a pressure of 98 N (10 kgf) on one side and a total pressure of 196 N (20 kgf). The lower surface of the fixing heater 16 is pressed against the elastic force of the elastic layer to the elastic layer of the press roller 22 via the fixing belt 20 at a predetermined press force, forming a fixing nip 27 with a predetermined width necessary for heating and fixing. The press mechanism has a press cancellation mechanism, and can easily cancel the pressure and remove the print medium P upon jamming or the like.

Reference numerals 18 and 19 denote two, main and sub thermistors serving as first and second temperature detection units. The main thermistor 18 serving as the first temperature detection unit is arranged in noncontact with the fixing heater 16 serving as a heating element. In the first embodiment, the main thermistor 18 elastically contacts the inner surface of the fixing belt 20 above the heater holder 17, and detects the temperature of the inner surface of the fixing belt 20. The sub-thermistor 19 serving as the second temperature detection unit is arranged closer to the fixing heater 16 serving as a heat source than the main thermistor 18. In the first embodiment, the sub-thermistor 19 contacts the back surface of the fixing heater 16, and detects the temperature of the back surface of the fixing heater 16.

The main thermistor 18 has a thermistor device which is attached to the distal end of a stainless steel arm 25 fixed and supported by the heater holder 17. The arm 25 elastically swings to always keep the thermistor device in contact with the inner surface of the fixing belt 20 even when the motion of the inner surface of the fixing belt 20 becomes unstable.

Figure 3:
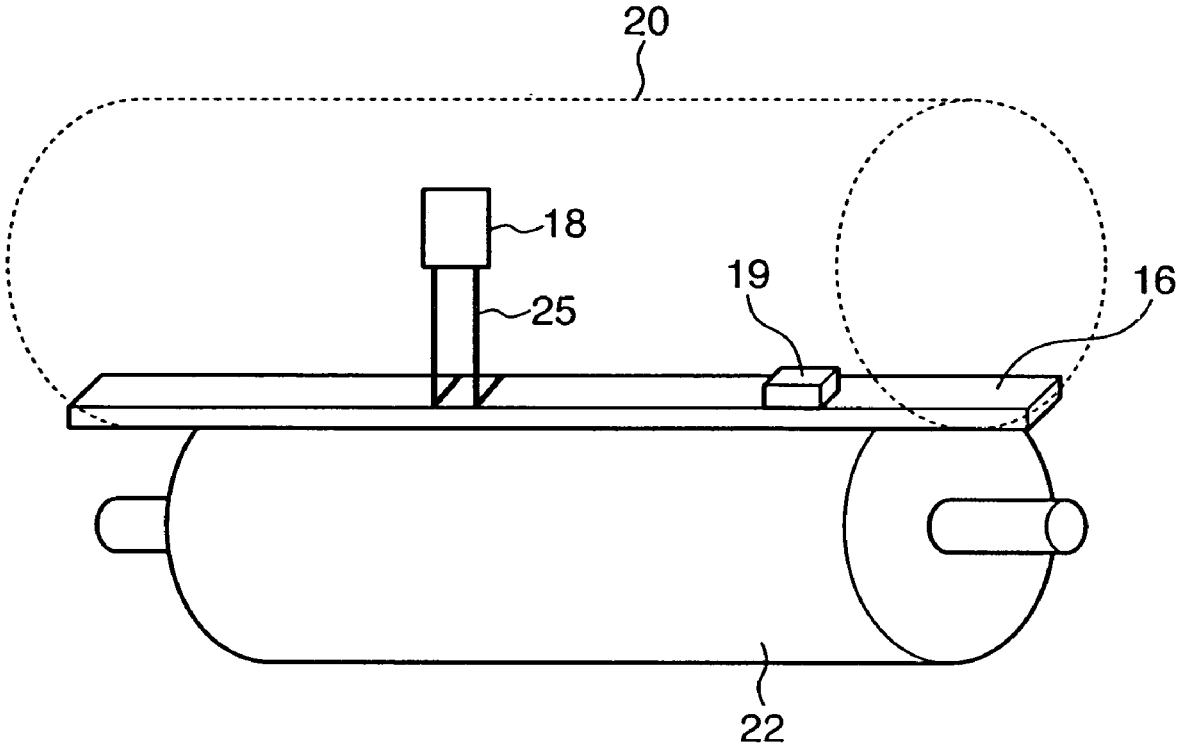
FIG. 3 depicts a schematic perspective view showing the positional relationship between a fixing heater, a main thermistor, and a sub-thermistor according to the first embodiment.

FIG. 3 depicts a schematic perspective view for explaining the positional relationship between the fixing heater 16, the main thermistor 18, and the sub-thermistor 19 in the fixing unit 12 according to the first embodiment.

The main thermistor 18 is disposed near the center of the fixing belt 20 along the longitudinal direction, whereas the sub-thermistor 19 is disposed near the end of the fixing heater 16. The main thermistor 18 and sub-thermistor 19 are arranged in contact with the inner surface of the fixing belt 20 and the back surface of the fixing heater 16, respectively.

As shown in FIG. 2, outputs from the main thermistor 18 and sub-thermistor 19 are input to a controller 21 via A/D converters 64 and 65. The controller 21 determines the temperature control contents of the fixing heater 16 on the basis of outputs from the main thermistor 18 and sub-thermistor 19. A heater driving circuit 28 (FIGS. 2 and 4A to 4C) serving as a power supply portion (heating unit) controls energization to the fixing heater 16. The configuration of the controller 21 will be described in detail with reference to FIG. 5.

Reference numerals 23 and 26 in FIG. 2 denote an inlet guide (23) and fixing/delivery rollers (26) which are assembled to the apparatus frame 24. The inlet guide 23 guides a transfer medium so as to accurately guide the print medium P having passed through the secondary transfer nip to the fixing nip 27 serving as a press contact portion between the fixing belt 20 and the press roller 22 at the fixing heater 16. The inlet guide 23 in the first embodiment is formed from a phenylene sulfide (PPS) resin.

The press roller 22 is driven by a driving portion (not shown) to rotate at a predetermined peripheral speed in a direction indicated by an arrow (FIG. 2). The rotational force acts on the cylindrical fixing belt 20 by the press-contact frictional force at the fixing nip 27 between the outer surface of the press roller 22 and the fixing belt 20 by rotational driving of the press roller 22. While the fixing belt 20 slides with its inner surface in tight contact with the lower surface of the fixing heater 16, the fixing belt 20 is driven to rotate around the heater holder 17 in a direction indicated by an arrow. The inner surface of the fixing belt 20 is greased to ensure slidableness between the heater holder 17 and the inner surface of the fixing belt 20.

The press roller 22 is driven to rotate, the cylindrical fixing belt 20 is driven to rotate along with this, and the fixing heater 16 is energized. The temperature of the fixing heater 16 rises to a predetermined temperature. In this temperature-controlled state, a print medium P bearing an unfixed toner image is guided and introduced along the inlet guide 23 between the fixing belt 20 and the press roller 22 at the fixing nip 27. The toner image bearing surface of the print medium P is brought into tight contact with the outer surface of the fixing belt 20 at the fixing nip 27, and the print medium P is clamped and conveyed together with the fixing belt 20 through the fixing nip 27. During clamping and conveyance, heat of the fixing heater 16 is applied to the print medium P via the fixing belt 20. An unfixed toner image t on the print medium P is heated, pressed, fused, and fixed onto the print medium P. The print medium P having passed through the fixing nip 27 self-strips from the fixing belt 20, and is discharged by the fixing/delivery rollers 26.

[Description of Main Thermistor 18]

As shown in FIGS. 2 and 3, the main thermistor 18 is arranged near the center of the fixing belt 20 along the longitudinal direction so as to contact the inner surface of the fixing belt 20. The main thermistor 18 is used as a unit for detecting the temperature of the fixing belt 20 that is closer to the temperature of the fixing nip 27. In normal operation, the temperature is controlled so that a temperature detected by the main thermistor 18 reaches a target temperature.

[Description of Sub-Thermistor 19]

As shown in FIG. 3, the sub-thermistor 19 is disposed near the end of the fixing heater 16 so as to contact the back surface of the fixing heater 16. The sub-thermistor 19 functions as a safety device for monitoring the temperature of the fixing heater 16 so as to prevent this temperature from reaching a predetermined temperature or higher.

The sub-thermistor 19 monitors the overshoot of the temperature of the fixing heater 16 at the start and the temperature rise at the end of the fixing heater 16. For example, the sub-thermistor 19 is used for determining whether to control to decrease the throughput so as to suppress the temperature rise at the end of the fixing heater 16 when the temperature at the end of the fixing belt 20 exceeds a predetermined temperature due to the temperature rise at the end of the fixing heater 16.

[Description of Fixing Heater 16]

In the first embodiment, the fixing heater 16 serving as a heat source is a ceramic heater prepared by coating an aluminum nitride substrate with a layer of a conductive paste containing a silver-palladium alloy at a uniform thickness by screen printing to form a resistance heating element, and coating this element with pressure-resistant glass.

Figures 4A, 4B, 4C:
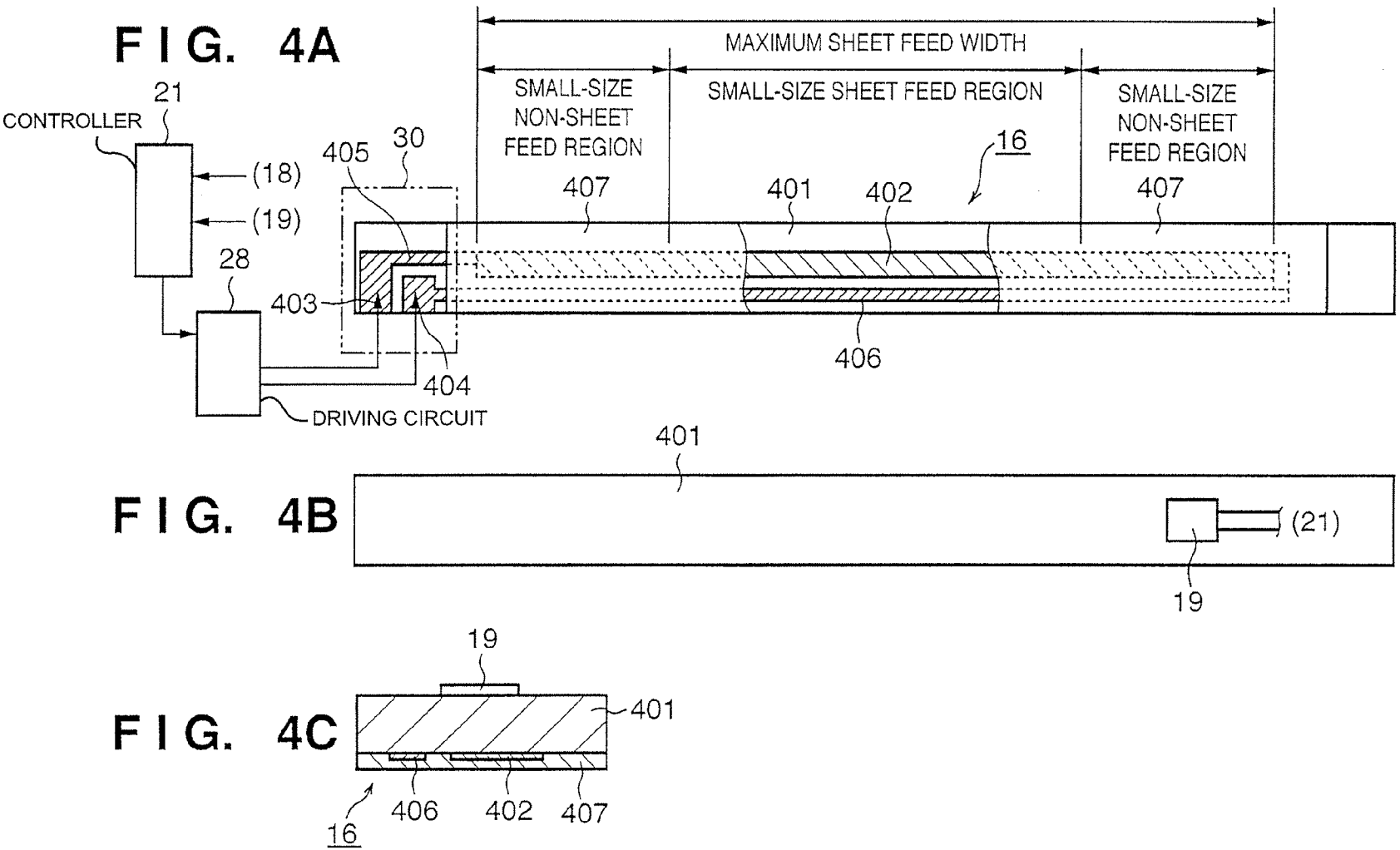
FIGS. 4A to 4C depict schematic views showing the structure of a ceramic heater serving as a heating element.

FIGS. 4A to 4C depict schematic views showing an example of the structure of the ceramic heater used as the fixing heater 16 according to the first embodiment. FIG. 4A depicts a partially notched schematic view showing the upper surface of the ceramic heater, FIG. 4B depicts a schematic view showing the back surface, and FIG. 4C depicts a schematic enlarged cross-sectional view.

The fixing heater 16 is formed from (a) a horizontally elongated aluminum nitride substrate 401 whose longitudinal direction is perpendicular to the sheet feed direction, (b) a resistance heating element layer 402 of a conductive paste about 10 μm thick and about 1 to 5 mm wide which is applied with a linear or band shape on the upper surface of the aluminum nitride substrate 401 along the longitudinal direction by screen printing and contains a silver-palladium (Ag/Pd) alloy that generates heat upon supply of a current, (c) first and second electrodes 403 and 404, and elongated current paths 405 and 406 which are formed by patterning a silver paste as a feed pattern for the resistance heating element layer 402 by screen printing or the like similarly on the upper surface of the aluminum nitride substrate 401, (d) a glass coat 407 as thin as about 10 μm which is formed on the resistance heating element layer 402 and elongated current paths 405 and 406 in order to protect them and ensure their insulating property, and can resist sliding with the fixing belt 20, and (e) the sub-thermistor 19 which is arranged on the back surface of the aluminum nitride substrate 401.

The fixing heater 16 is fixed and supported by the heater holder 17 with the upper surface exposed down. A feed connector 30 is mounted on that side of the fixing heater 16 which has the first and second electrodes 403 and 404. Power is fed from the heater driving circuit 28 to the first and second electrodes 403 and 404 via the feed connector 30. The resistance heating element layer 402 then generates heat to quickly raise the temperature of the fixing heater 16. The heater driving circuit 28 is controlled by the controller 21.

In normal use, the fixing belt 20 is driven to rotate at the same time as the start of rotating the press roller 22. As the temperature of the fixing heater 16 rises, the temperature of the inner surface of the fixing belt 20 also rises. Energization to the fixing heater 16 is PID-controlled, and input power is so controlled as to keep the temperature of the inner surface of the fixing belt 20, i.e., a temperature detected by the main thermistor 18 at 190° C.

[Description of Fixing Heater Driving Circuit 28]

Figure 5:
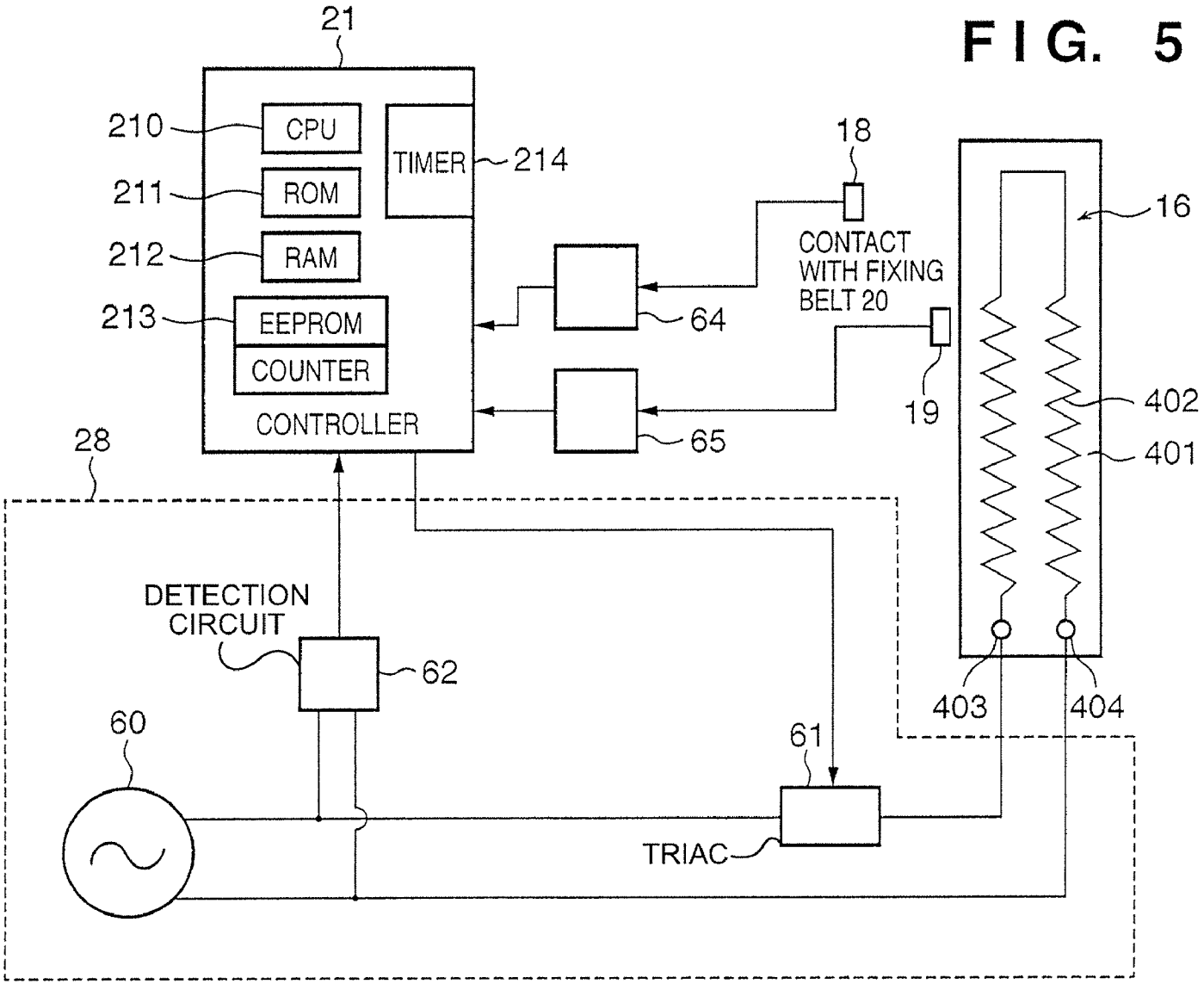
FIG. 5 is a block diagram showing the controller and fixing heater driving circuit of the fixing unit according to the first embodiment.

FIG. 5 is a block diagram showing the controller 21 and fixing heater driving circuit 28 serving as a temperature detection unit for the fixing unit 12 according to the first embodiment. The feed electrodes 403 and 404 of the fixing heater 16 are connected to the fixing heater driving circuit 28 via feed connectors (not shown).

The fixing heater driving circuit 28 comprises an AC power supply 60, a triac 61, a zero-crossing detection circuit 62, and the controller 21. The triac 61 is controlled by the controller 21. The triac 61 supplies and stops power to the resistance heating element layer 402 of the fixing heater 16.

The AC power supply 60 sends a zero-crossing signal to the controller 21 via the zero-crossing detection circuit 62. The controller 21 controls the triac 61 on the basis of the zero-crossing signal. By energizing the resistance heating element layer 402 of the fixing heater 16 by the fixing heater driving circuit 28, the temperature of the overall fixing heater 16 rapidly rises. Outputs from the main thermistor 18 which detects the temperature of the fixing belt 20 and the sub-thermistor 19 which detects the temperature of the fixing heater 16 are supplied to the controller 21 via A/D converters 64 and 65. Based on temperature information of the fixing heater 16 from the main thermistor 18, the controller 21 controls heater energization power by phase/wave number control of an AC voltage applied to the fixing heater 16 by the triac 61 so as to maintain the temperature of the fixing heater 16 at a predetermined target control temperature (set temperature). That is, the temperatures of the main thermistor 18 and sub-thermistor 19 are monitored as voltage values by the controller 21. In accordance with these temperatures, energization power to the fixing heater 16 is so controlled as to maintain the temperature of the fixing belt 20 at a predetermined set temperature and drive the fixing heater 16 at a predetermined temperature or less.

The controller 21 comprises a CPU 210 such as a microprocessor, a ROM 211 which stores control programs and data for the CPU 210, a RAM 212 which is used as a work area in executing control by the CPU 210 and temporarily stores various data, and an EEPROM 213 which stores control information (to be described later) and the like in a nonvolatile state. Reference numeral 214 denotes a timer used to measure the activation time interval (to be described later) of the fixing unit.

A representative temperature control method by the controller 21 is PID control. The power control method includes wave number control and phase control, and will be explained using phase control.

More specifically, the controller 21 detects the temperature of the main thermistor 18 every 2 μsec, and determines a power supply amount to the fixing heater 16 by PID control so as to control the temperature to a desired one. For example, power is generally designated in 5% steps by using a conducting angle in 5% steps with respect to one half-wave of the AC waveform supplied from the AC power supply 60. This conducting angle is obtained as a timing at which the triac 61 is turned on after the zero-crossing detection circuit 62 detects a zero-crossing signal.

[Description of Fixing Belt 20]

In the first embodiment, the fixing belt 20 is a cylindrical (endless belt-like) member prepared by forming an elastic layer on a belt-like member. More specifically, a silicone rubber layer (elastic layer) about 300 μm thick is formed by ring coating on an endless belt (belt base) formed from SUS with a 30-μm thick cylindrical shape. The silicone rubber layer is coated with a 30-μm thick PFA resin tube (uppermost layer). The heat capacity of the fixing belt 20 formed with this structure was measured to be $12.2\times10^{-2}$ J/cm$^{2\circ}$ C. (heat capacity per cm$^2$ of the fixing belt).

(a) Base Layer of Fixing Belt 20

The base layer of the fixing belt 20 can use a resin such as polyimide. However, a metal such as SUS or nickel has a thermal conductivity about 10 times as large as that of polyimide, and can provide a more excellent on-demand characteristic. The first embodiment, therefore, uses SUS as a metal for the base layer of the fixing belt 20.

(b) Elastic Layer of Fixing Belt 20

The elastic layer of the fixing belt 20 uses a rubber layer having a relatively higher thermal conductivity in order to obtain a more excellent on-demand characteristic. The material used in the first embodiment has a specific heat of about $12.2\times10^{-1}$ j/g° C.

(c) Mold Release Layer of Fixing Belt 20

By forming a fluoroplastic layer on the surface of the fixing belt 20, the mold release property of the surface can be increased to prevent an offset phenomenon which occurs when toner is temporarily attached to the surface of the fixing belt 20 and moved again to the print medium P. A uniform fluoroplastic layer can be more easily formed by shaping the fluoroplastic layer on the surface of the fixing belt 20 into a PFA tube.

(d) Heat Capacity of Fixing Belt 20

In general, as the heat capacity of the fixing belt 20 increases, the temperature slowly rises, impairing the on-demand characteristic. Assuming a rise within 1 min without any standby temperature control, the heat capacity of the fixing belt 20 must be suppressed to about 4.2 J/cm$^{2\circ}$ C. though this depends on the configuration of the fixing unit 12.

In the first embodiment, the heat capacity is designed so that the fixing belt 20 rises to 190° C. within 20 sec upon application of power of about 1,000 W to the fixing heater 16 at the start of a rise from room temperature. The silicone rubber layer uses a material having a specific heat of about $12.2\times10^{-1}$ j/g° C. At this time, the thickness of silicone rubber must be 500 μm or less, and the heat capacity of the fixing belt 20 must be about $18.9\times10^{-2}$ j/cm$^{2\circ}$ C. or less. To the contrary, to keep $4.2\times10^{-2}$ J/cm$^{2\circ}$ C. or less, the rubber layer of the fixing belt 20 becomes extremely thin. In this case, the image quality such as the OHP transparency or gloss nonuniformity becomes almost equal to that of an on-demand fixing unit having no elastic layer.

In the first embodiment, the thickness of silicone rubber necessary to obtain a high-quality image in terms of the OHP transparency and gloss setting was 200 μm or more. The heat capacity was $8.8\times10^{-2}$ 2 J/cm$^{2\circ}$ C.

That is, the heat capacity of the fixing belt 20 in the configuration of a fixing unit similar to the first embodiment generally targets $4.2\times10^{-2}$ J/cm$^{2\circ}$ C. (inclusive) to 4.2 J/cm$^{2\circ}$ C. (inclusive). The first embodiment employs a fixing belt having a heat capacity of $8.8\times10^{-2}$ J/cm$^{2\circ}$ C. (inclusive) to $18.9\times10^{-2}$ J/cm$^{2\circ}$ C. (inclusive) at which both the on-demand characteristic and high image quality can be achieved.

[Fixing Temperature Determination Method]

A fixing temperature determination method according to the first embodiment will be explained. The activation count of the fixing unit 12 will be called a start-up count, and an approximate time till the next activation after the stop of operating the image forming apparatus will be called an intermittent time in the first embodiment. FIG. 6 shows an example of a value counted up every start-up (activation of the fixing unit) in accordance with the intermittent time in the first embodiment.

In the "plain sheet mode" of the continuous printing, the count value is counted by "0.1" per print in correspondence with the number of printed sheets. The count-up value per print is changed depending on the print mode. In the "OHP mode" of the continuous printing, the count-up value per print is set to "0.5". This is because the process speed is low, the sheet feed interval is long, and the temperature of the press roller 22 more greatly rises.

FIG. 6 depicts a table for explaining the relationship between the intermittent time and a value counted up every start-up of the fixing unit 12 in the intermittent printing.

As shown in FIG. 6, each of the counted-up values is set in accordance with each of the intermittent times and the counted-up values become smaller as the intermittent time becomes longer. The counted-up value changes depending on the intermittent time in order to cope with the temperature fall of the press roller 22 upon a long intermittent time. After an intermittent time of 300 sec or more elapses (* in FIG. 6), "0.2" is subtracted from the count value regardless of activation of the fixing unit 12 upon the lapse of every 10 sec. Note that this value "0.2" is determined for the fixing unit 12 according to the first embodiment. If necessary, the counted-up may be obtained by calculation of weighting every elapsed time or selected from a table.

The counted-up result is stored in the EEPROM 213. The EEPROM 213 is used to predict the temperature of the press roller 22 at high precision even when the power supply is suddenly turned off/on immediately after printing after the temperature of the press roller 22 rises. However, the intermittent time cannot be measured when the power supply is turned off immediately after printing and then on again. In this case, the counted-up value is reset by presetting the intermittent time in accordance with an elapsed time from the power-on time which is set to be 0 sec. The count in printing enables predicting a time elapsed after previous activation of the fixing unit by comparing a count value stored in the EEPROM 213 and a count value obtained from a temperature detected by the sub-thermistor 19 in FIG. 14.

Figure 17:
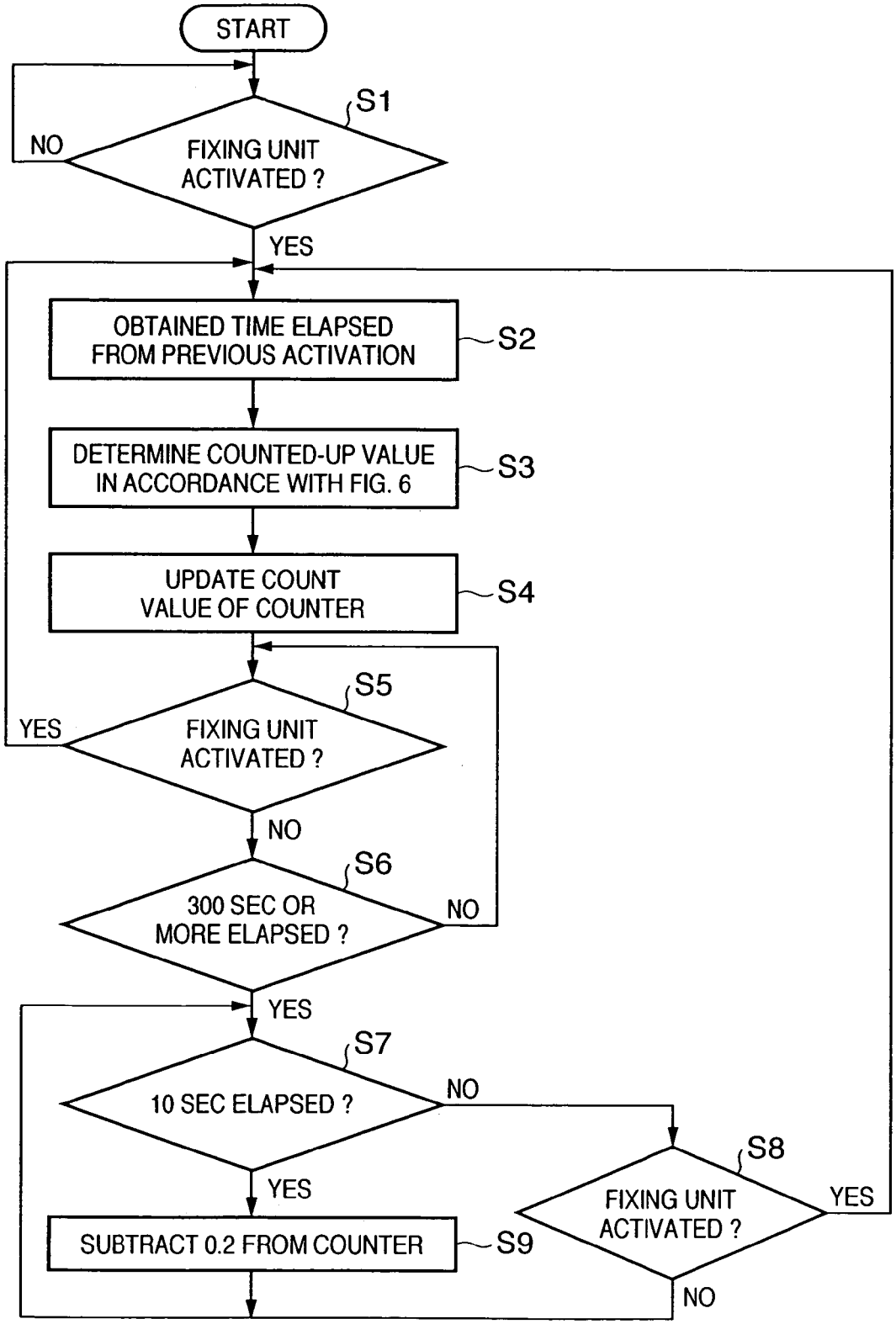
FIG. 17 is a flowchart showing a process of updating a count value in an EEPROM in the intermittent printing by the image forming apparatus according to the first embodiment of the present invention.

FIG. 17 is a flowchart for explaining a process of updating a count value stored in the EEPROM 213 in the intermittent printing. A program which executes this process is stored in the ROM 211.

The process starts upon activation of an intermittent print process. In step S1, the process waits until the fixing unit 12 is activated. After the fixing unit 12 is activated, the flow advances to step S2 to obtain a time elapsed after previous activation. The elapsed time can be obtained by the timer 214. In step S3, a value to be counted up (additional value to be updated) is obtained in accordance with the elapsed time and the set value in FIG. 6. The flow advances to step S4 to read out a count value of a counter stored in the EEPROM 213, add (or subtract upon the lapse of 300 sec or more) the counted-up value determined in step S3 to the count value, and store the count value in the counter in the EEPROM 213 again so as to update the counter.

The flow advances to step S5, and waits until the fixing unit 12 is temporarily stopped and activated again. If the fixing unit 12 is activated, the flow returns to step S2; if NO, advances to step S6 to determine whether 300 sec or more has elapsed after previous activation of the fixing unit 12. If NO in step S6, the flow returns to step S5 to determine whether the fixing unit 12 is activated again, or if the fixing unit stops, measure the elapsed time. If 300 sec or more has elapsed in step S6, the flow advances to step S7 to determine whether another 10 sec has elapsed. If NO in step S7, the flow advances to step S8 to determine whether the fixing unit 12 is activated again. If YES in step S8, the flow returns to step S2; if NO, advances to step S7. If YES in step S7, the flow advances to step S9 to subtract 0.2 from the count value of the counter in the EEPROM 213. If the count value becomes negative by subtraction in step S9, the count value of the counter is kept at "0".

In this manner, the count value corresponding to the start-up count value (counted-up value) stored in the EEPROM 213 can be attained.

FIG. 7 depicts a table showing, in accordance with the type of print medium (print sheet), the temperature of the press roller 22 and fixing temperature control which correspond to the count value of the above-described counter.

In FIG. 7, the temperature values of the press roller 22 in the "plain sheet mode" and "OHP mode" represent temperature values experimentally obtained in correspondence with each count value, and correspond to temperatures of the press roller 22 that are predicted from the count value. Fixing temperature control means temperature control in each mode corresponding to the count value of the counter. Energization to the fixing heater 16 is so controlled as to adjust a temperature (700 or 701 in FIG. 7) detected by the main thermistor 18 to a target temperature of each fixing temperature control. In this case, the first temperature control to seventh temperature control are set in accordance with respective target temperatures. The tables of FIGS. 6 and 7 are stored in the ROM 211 of the controller 21, or if they need to be properly updated, in the EEPROM 213.

Figure 18:
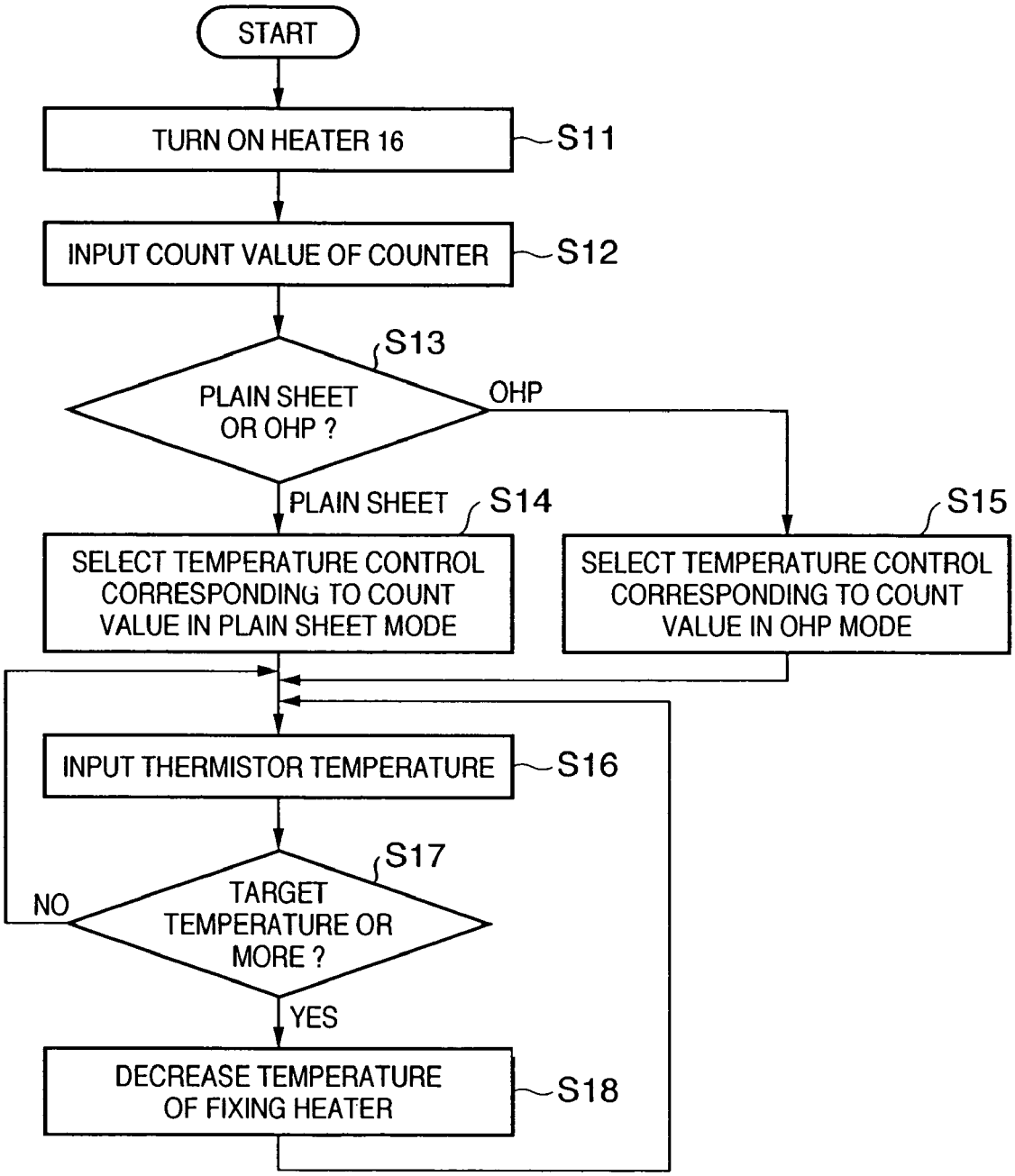
FIG. 18 is a flowchart showing a process of controlling the temperature of a fixing heater in the image forming apparatus according to the first embodiment of the present invention.
Figure 19:
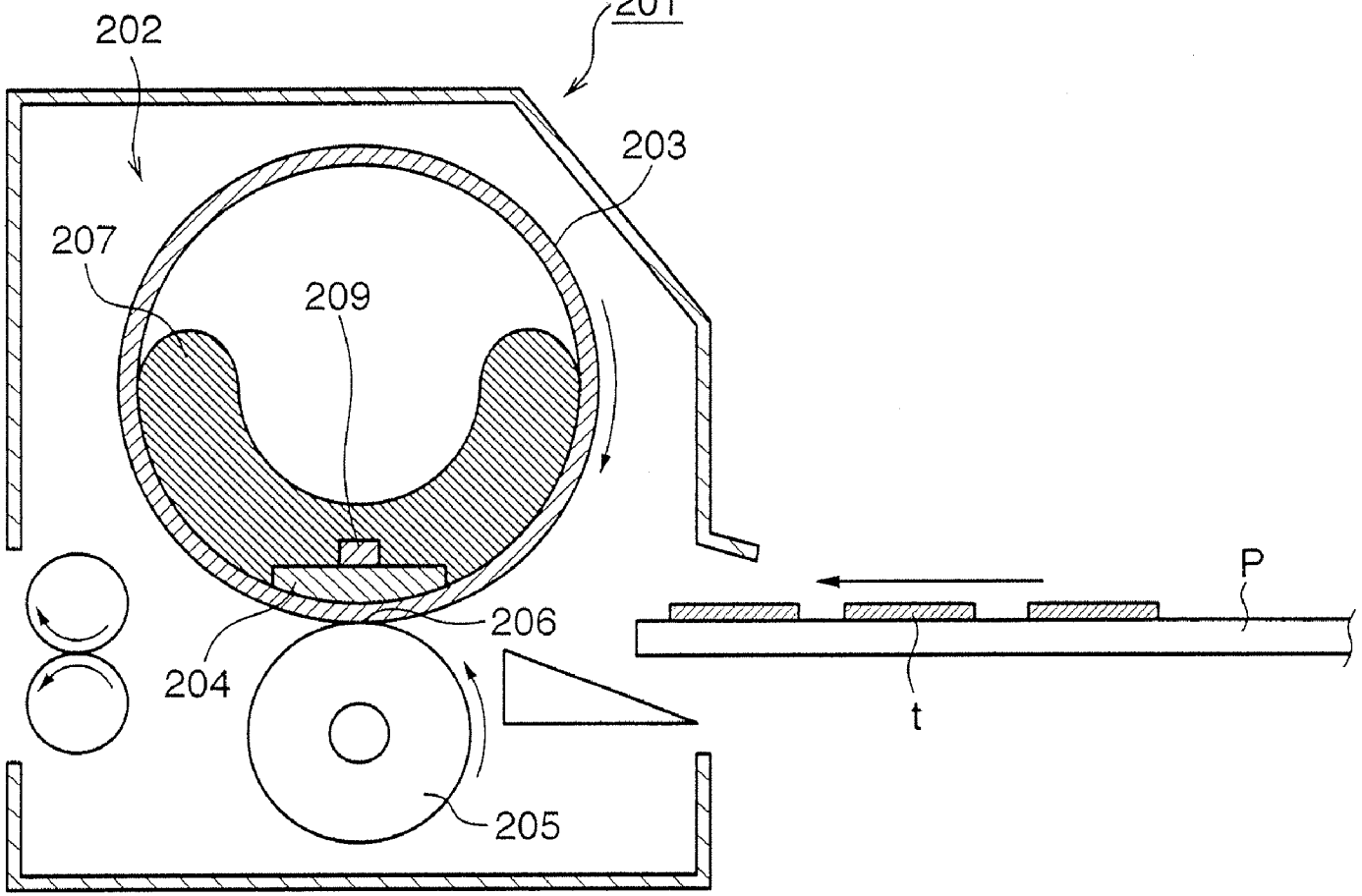
FIG. 19 PRIOR ART
FIG. 19 depicts a schematic sectional view showing a conventional belt fixing type fixing unit.
Figure 20:
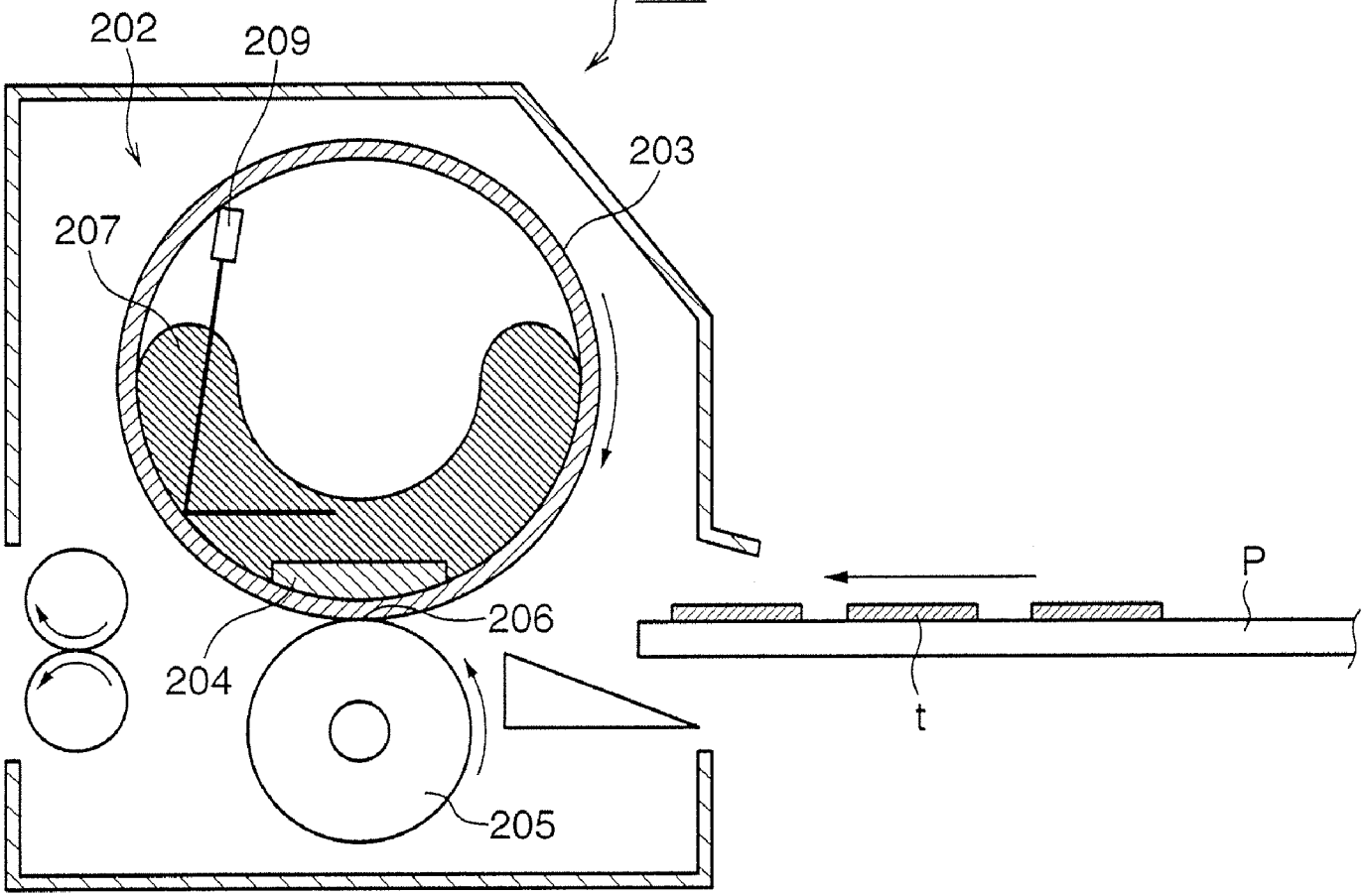
FIG. 20 PRIOR ART
FIG. 20 depicts a schematic sectional view showing a fixing unit using a thermistor which abuts against the inner surface of a fixing belt in the conventional belt fixing system.

FIG. 18 is a flowchart for explaining control of the fixing unit 12 according to the first embodiment. A program which executes this process is stored in the ROM 211, and executed under the control of the CPU 210. This process is executed in almost parallel to the flowchart of FIG. 17 described above.

The process starts at a timing at which the fixing unit 12 is activated, and the fixing heater 16 is turned on in step S11. The flow advances to step S12 to load a count value of the counter stored in the EEPROM 213. In step S13, whether the type of print medium is a plain sheet or OHP is determined. If the type of print medium is a plain sheet, the flow advances to step S14 to select temperature control corresponding to the count value and plain sheet mode from FIG. 7. If the type of print medium is an OHP in step S13, the flow advances to step S15 to select temperature control corresponding to the count value and OHP mode from FIG. 7. The flow advances to step S16 to obtain a temperature detected by the main thermistor 18 and determine whether the temperature has reached a target temperature value (700 or 701 in FIG. 7) set in step S14 or S15. If the temperature has not reached the target temperature value (NO in step S17), the flow returns to step S16; if YES, the flow advances to step S18 to control to decrease the temperature of the fixing heater 16. Temperature control of the fixing heater 16 is executed by the above-mentioned fixing heater driving circuit 28 in accordance with an instruction from the controller 21.

The first embodiment sets different modes depending on the type of print medium. When the print medium is a plain sheet having a basis weight of 60 to 105 [g/m], printing is done in the "plain sheet mode". When the print medium is an OHP, printing is done in the "OHP mode".

As described above, the use of a counted-up value complying with the start-up count of the fixing unit 12 makes it possible to predict the temperature of the press roller 22 at high precision. By executing temperature control of the fixing unit 12 in accordance with the predicted temperature of the press roller 22, an image failure generated at an improper temperature of the fixing heater 16 or winding of a print medium can be prevented. As a result, a high-quality image with good fixation without any nonuniformity of the print quality such as the gloss value can be obtained.

As for counting of the start-up count in consideration of the saturation point of the temperature rise of the press roller 22, when the count value exceeds "50.0" in the intermittent printing, the temperature of the press roller 22 is considered to be a saturation temperature, and thus the start-up count is not counted up. As for the count value of the counter in the "plain sheet mode" of the continuous printing, the counter is not counted up when the count value exceeds "25.0" (135° C. or more in FIG. 7). Similarly, as for the number of printed sheets in the "OHP mode" of the continuous printing, the count value of the counter is not counted up when the count value exceeds "35.0" (130° C. or more in FIG. 7) because the saturation temperature of the press roller 22 is higher than that in the "plain sheet mode".

The number of sheets in continuous printing and the count value of the counter are properly determined in accordance with the process speed, the control temperature, and the sheet interval. The above method can make an appropriate temperature of the press roller 22 and a count value of the counter correspond to each other even when the saturation temperature of the press roller 22 changes between continuous printing and intermittent printing.

[Experimental Result of Image Output According to First Embodiment]

An image output result according to the first embodiment will be explained.

(1) Experimental Method

The process speed of the image forming apparatus was 100 mm/sec in the "plain sheet mode" and 30 mm/sec in the "OHP mode". As continuous printing, 400 sheets were continuously printed in the "plain sheet mode". As intermittent printing, printing of five sheets was repeated 80 times at an interval of 10 sec in the "plain sheet mode". After that, 10 OHP sheets were printed after 30 sec in both continuous printing and intermittent printing. Office Planner (trademark) was used as the plain sheet, and the gloss and fixation of every 10 printed sheets were measured to confirm a hot offset. The gloss was represented by the average value of single Y, M, and C colors in solid printing and the variation width, whereas the fixation was represented by the worst value of a measured density decrease ratio. A color OHP sheet TR-3 (trade name) was used as the OHP sheet, and the transparency of yellow solid printing was measured.

The temperature of the press roller 22 was measured by arranging an E type thermocouple 529E available from Anritsu in contact with the vicinity of the center on the surface of the press roller 22, A/D-converting the temperature by a temperature recorder NR250 for PC available from Keyence, and supplying the converted value to a PC.

The gloss of a fixed image was measured by 750 specular glossiness measurement method JIS Z 8741 using a glossmeter PG-3D available from Nippon Denshoku as a measuring device.

Fixing was done while the toner amounts of solid image portions of so-called primary colors, i.e., yellow, magenta, and cyan were about 0.5 to 0.6 mg/cm$^2$ as toner amounts on a print medium. The gloss of a fixed image was measured.

As a rubbing test for evaluating fixation, a 5 mm×5 mm-solid image in single black color was formed and fixed on a print medium P by using the fixing unit according to the first embodiment. The image forming surface was reciprocally rubbed five times while a weight of a predetermined weight (200 g) was set on the image forming surface via Silbon C (trade name). The reflection density decrease ratio (%) of the image before and after rubbing was obtained. A lower change ratio (density decrease ratio) of the reflection density means better fixation. The reflection density was measured using Gretag Macbeth RD918 (trademark). Measurement adopted the worst value among density decrease ratios measured at nine points on a printed sheet every 11th print medium out of fixed print media.

As for the OHP transparency, a transparent OHP 9550 available from 3M was used, and Spectra Scan PR650 available from Photo Research was used as a spectrometer. The spectrum of an image projected from an OHP onto a screen was measured by this spectrometer in a darkroom environment. As measurement procedures, the spectrum was measured as a reference value while no OHP sheet sample to be measured was set on an OHP. An OHP sheet sample to be measured was set on the OHP, and the spectrum of a projected image was measured. L*, C*, and H* were calculated from the difference from the reference value, and the L* value was used as transparency data. As a measurement patch, the transparency of a yellow solid portion was measured.

(2) Experimental Result

The experimental results will be explained.

FIGS. 8A and 8B depict tables showing a count value, the temperature of the press roller 22, and the measurement result of temperature control selected by the fixing unit 12 for each number of printed sheets in continuous printing (FIG. 8A) and intermittent printing (FIG. 8B).

The saturation temperature was different between continuous printing and intermittent printing: when a plain sheet was fed, the temperature of the press roller 22 saturated at about 140° C. (fifth temperature control) in continuous printing and about 170° C. (seventh temperature control) in intermittent printing. Even if the number of printed sheets increased in continuous printing and intermittent printing, the count, the temperature range of the press roller 22, and selection of temperature control fell within the range of the relationship shown in FIG. 7.

FIG. 9 depicts a table showing an example of image evaluation results in continuous printing and intermittent printing.

A stable gloss and transparency could be obtained regardless of continuous printing and intermittent printing. Good fixation was exhibited, and no image failure such as hot offset occurred.

As described above, a high-quality image with good fixation free from any nonuniformity of the print quality could be obtained without winding a print medium or generating any image failure when the control temperature of the fixing unit 12 was improper.

COMPARATIVE EXAMPLE 1

An image output result using the prior art will be explained.

(1) Experimental Method

As the prior art, the fixing temperature was determined by sheet count control. In sheet count control, the saturation temperature of the press roller 22 in continuous printing and that of the press roller 22 in intermittent printing are different, and only a temperature controlled in accordance with either saturation temperature can be selected, as described above. In the fixing unit 12 according to the first embodiment, the saturation temperature of the press roller 22 is about 140° C. in continuous printing and about 170° C. in intermittent printing in the "plain sheet mode". In continuous printing, the temperature of the press roller 22 reaches the saturation temperature of about 140° C. at a control sheet count (apparent printed sheet count) of 250 sheets. From the relationship shown in FIG. 7, the final temperature control was adjusted to the fifth temperature control at 250 sheets, and the temperature was not decreased from the temperature of the fifth temperature control (called control A). In intermittent printing, the temperature of the press roller 22 reaches the saturation temperature of about 170° C. at a control sheet count of 500 sheets. From the relationship shown in FIG. 7, the final temperature control was adjusted to the seventh temperature control at 500 sheets, and the temperature was not decreased from the temperature of the seventh temperature control (called control B). An experiment identical to that described above was conducted by performing sheet count control by these two methods.

(2) Experimental Result

Results in the use of control (control A) assuming continuous printing are shown in FIGS. 10A, 10B, and 11.

FIGS. 10A and 10B depict tables for explaining results in the use of control operations assuming continuous printing (FIG. 10A) and intermittent printing (FIG. 10B).

In continuous printing, as shown in FIG. 10A, even if the number of printed sheets increased, the temperature of the press roller 22 and selection of the control temperature fell within the range of the relationship shown in FIG. 7. At this time, no image failure occurred.

In intermittent printing (FIG. 10B), however, the relationship between the temperature of the press roller 22 and the control temperature as shown in FIG. 7 could not be maintained (portion 1000 in FIG. 10B). This is because the saturation temperature of the press roller 22 becomes higher in intermittent printing than in continuous printing, whereas sheet count control has reached the maximum number of sheets and the control temperature does not decrease. As a result, a control temperature higher than the temperature of the press roller 22 in intermittent printing is selected. At this time, as shown in FIG. 11, an image was influenced (hatched fields in FIG. 11). Although the average value of the gloss increased, the variation width throughout printing increased, a hot offset occurred, and an OHP (seventh OHP) was wounded. These problems were caused by an excessive heat amount to the print medium P.

Results in the use of control (control B) assuming intermittent printing are shown in FIGS. 12A, 12B, and 13.

FIGS. 12A and 12B depict tables for explaining results in the use of control operations assuming continuous printing (FIG. 12A) and intermittent printing (FIG. 12B).

In intermittent printing, as shown in FIGS. 12A and 12B, even if the number of printed sheets increased, the temperature of the press roller 22 and selection of the control temperature fell within the range of the relationship shown in FIG. 7. In continuous printing in FIG. 12A, however, the relationship between the temperature of the press roller and the control temperature as shown in FIG. 7 could not be maintained (portion 1200 in FIG. 12A). This is because the saturation temperature of the press roller 22 becomes lower in continuous printing than in intermittent printing, whereas sheet count control has not reached the maximum number of sheets and thus the control temperature excessively decreases as the number of sheets increases. Consequently, a control temperature lower than the temperature of the press roller 22 in continuous printing is selected. At this time, as shown in FIG. 13, a printed image was influenced (hatched fields in FIG. 13). The average value of the gloss decreased, the variation width throughout printing increased, fixation degraded, and the OHP transparency also degraded. These problems were caused by an insufficient heat amount to the print medium P.

As described above, according to the first embodiment, by using a count value of the counter based on a counted-up value complying with the start-up count of the fixing unit, the temperature of the press roller 22 can be predicted at high precision, and a control temperature complying with the temperature of the press roller 22 can be selected.

[Second Embodiment]

The second embodiment will describe a method of, when the intermittent time is sufficiently long, detecting the temperature of a press roller 22 by using a sub-thermistor 19 in contact with a fixing heater 16 in the use of the fixing unit 12 described in the first embodiment, and thereby accurately controlling the temperature of the press roller 22.

A fixing unit 12 in the second embodiment has the same configuration as that in the first embodiment, and a description thereof will be omitted. The second embodiment is different from the first embodiment in that when the intermittent time is sufficiently long, the temperature of the press roller 22 is detected and a count value corresponding to the detected temperature is set to a counter in the EEPROM 213.

A method of counting up the start-up count is the same as that in the first embodiment describe above, as shown in FIG. 6, and a description thereof will be omitted.

FIG. 14 depicts a table for explaining an example of setting a count value to the counter in the EEPROM 213 when the intermittent time is sufficiently long in an image forming apparatus according to the second embodiment.

A temperature detected by the sub-thermistor 19 can be regarded to reflect the temperature of the press roller 22 because when the apparatus is OFF, the heater 16 is not heated and is arranged closest to the press roller 22.

As shown in FIG. 14, when the intermittent time is sufficiently long (e.g., exceeds 300 sec), the count value is changed every start-up. In this case, the temperature of the press roller 22 is detected on the basis of a temperature detected by the sub-thermistor 19 before start-up, and the count value is determined in correspondence with the temperature of the press roller 22 (temperature detected by the sub-thermistor 19) and the determined count value is set to the counter.

A method of holding a count value of the counter in an EEPROM 213 when the intermittent time is short, a counting method considering the number of printed sheets, and a method of selecting a control temperature are the same as those in the first embodiment described above, and a description thereof will be omitted.

For example, when a count value in FIG. 14 corresponding to a temperature detected by the sub-thermistor 19 is "4.0" or less (temperature detected by the sub-thermistor 19 is 45° C. or less), it is determined that a satisfactory time has elapsed upon power-off/on after the end of printing, and the count value in FIG. 14 obtained from a temperature detected by the sub-thermistor 19 is directly set into the counter. When a count value corresponding to a temperature detected by the sub-thermistor 19 is "20.0" or more (temperature detected by the sub-thermistor 19 is 95° C. or less), it is determined that no satisfactory time has elapsed upon power-off/on after the end of printing, and the value of the counter in the EEPROM 213 is used as a count value. When a count value in FIG. 14 corresponding to a temperature detected by the sub-thermistor 19 falls within a range of "4.1" (inclusive) to "20.0" (inclusive) (temperature detected by the sub-thermistor 19 falls within a range of 45° C. (inclusive) to 95° C. (inclusive)), it is determined that the count value is an intermediate value between the above-described two cases. The intermediate value between the value of the counter in the EEPROM 213 and a count value in FIG. 14 obtained from a temperature detected by the sub-thermistor 19 is determined as a count value and set to the counter.

This setting of the counter prevents a predicted temperature (count value) from greatly deviating from the temperature of the press roller 22 even upon sudden power-off/on.

A change in the temperature of the press roller 22 between continuous printing and intermittent printing can be predicted at high precision by the following process.

As described in the first embodiment, in the "plain sheet mode" of the continuous printing, the count value is counted by "0.1" per print in correspondence with the number of printed sheets. The count-up value per print is changed depending on the print mode. In the "OHP mode" of the continuous printing, the count-up value per print is set to "0.5". This is because the process speed is low, the sheet feed interval is long, and the temperature of the press roller 22 more greatly rises.

The relationship between the count value of the counter by the above-mentioned counting method, the temperature ranges of the press roller 22 in the "plain sheet mode" and "OHP mode" that correspond to the count value, and control temperatures in the "plain sheet mode" and "OHP mode" that correspond to the temperature of the press roller 22 is the same as FIG. 7 described above.

As for counting of the start-up count in consideration of the saturation point of the temperature rise of the press roller 22, when the count value exceeds "50.0" in the intermittent printing, the temperature of the press roller 22 is considered to be a saturation temperature, and thus the start-up count is not counted up. As for the count value of the counter in the "plain sheet mode" of the continuous printing, the counter is not counted up when the count value exceeds "25.0" (135° C. or more in FIG. 7). Similarly, as for the number of printed sheets in the "OHP mode" of the continuous printing, the count value of the counter is not counted up when the count value exceeds "35.0" (130° C. or more in FIG. 7) because the saturation temperature of the press roller 22 is higher than that in the "plain sheet mode".

The number of sheets in continuous printing and the count value of the counter are properly determined in accordance with the process speed, the control temperature, and the sheet interval. The above method can make an appropriate temperature of the press roller 22 and a count value of the counter correspond to each other even when the saturation temperature of the press roller 22 changes between the continuous printing and intermittent printing.

As described above, according to the second embodiment, by using a count value of the counter complying with the start-up count of the fixing unit 12, the temperature of the press roller 22 can be predicted at high precision regardless of the use state of the fixing unit 12. Also, a control temperature complying with the temperature of the press roller 22 can be selected, and an image failure generated at an improper fixing control temperature or winding of a print medium can be prevented. Hence, a high-quality image with good fixation without any nonuniformity of the print quality such as the gloss value can be obtained.

[Third Embodiment]

In the third embodiment, the present invention can be applied to a fixing unit different from the fixing unit described in the first and second embodiments, and the same effects can be obtained. In the fixing unit adopted in the third embodiment, a thermistor cannot detect the approximate temperature of a press roller 22. However, by applying the present invention to this fixing unit, the temperature of the press roller 22 can be predicted at high precision regardless of the use state of the fixing unit, and a control temperature complying with the temperature of the press roller 22 can be selected.

The third embodiment will be described by using a so-called induction heating type fixing unit as a fixing unit different from the fixing unit described in the first embodiment.

Figure 15:
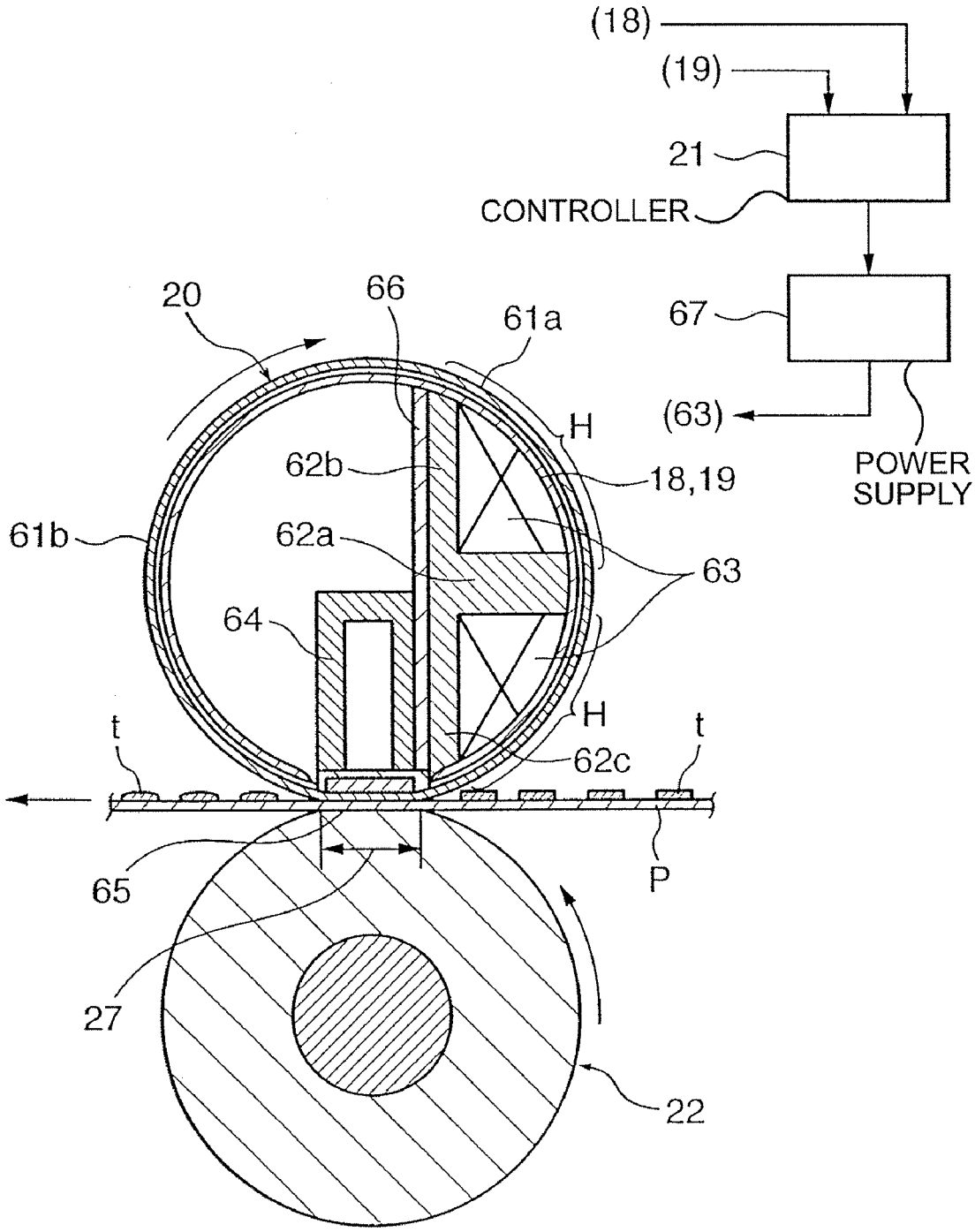
FIG. 15 depicts a schematic view showing the schematic configuration of an electromagnetic induction heating type fixing unit according to the third embodiment of the present invention.

FIG. 15 depicts a schematic view showing the configuration of an electromagnetic induction heating type fixing unit according to the third embodiment of the present invention.

A magnetic field generation unit is formed from magnetic cores 62*a*, 62*b*, and 62*c* and an exciting coil 63. The magnetic cores 62*a*, 62*b*, and 62*c* are high-permeability members, and are preferably formed from a material such as ferrite or permalloy used for the core of a transformer, and more preferably ferrite which hardly exhibits a loss even at 100 kHz or more.

Reference numeral 67 denotes a high-frequency generation circuit serving as a power supply portion (feed portion) which can generate a high frequency of 20 kHz to 500 kHz from a switching power supply. The exciting coil 63 generates an alternating flux by an alternating current (high-frequency current) supplied from the power supply portion 67. Reference numerals 61*a* and 61*b* are belt guide members each having an almost semicircular troughed cross section. The belt guide members 61*a* and 61*b* form an almost columnar member with their openings facing each other, and a fixing belt (fixing sleeve or first rotary body) 20 serving as a cylindrical electromagnetic induction heating belt is loosely fitted outer the columnar member. The belt guide member 61*a* internally holds the magnetic cores 62*a*, 62*b*, and 62*c* and exciting coil 63 which function as the magnetic field generation unit. The belt guide member 61*a* has a sliding member 65 which is disposed inside the fixing belt 20 on that surface of a fixing nip 27 which faces the press roller 22. Reference numeral 64 denotes a horizontally elongated press rigid stay which abuts against the flat inner surface of the belt guide member 61*b*. Reference numeral 66 denotes an insulating member which insulates the magnetic cores 62*a*, 62*b*, and 62*c* and exciting coil 63 from the press rigid stay 64.

The press rigid stay 64 applies a press force by a press mechanism (not shown). The sliding member 65 on the lower surface of the belt guide member 61*a* and the press roller 22 press-contact each other via the fixing belt 20, forming the fixing nip 27 with a predetermined width.

The press roller 22 is driven by a driving portion (not shown) to rotate counterclockwise as indicated by an arrow. The rotational force acts on the fixing belt 20 by the frictional force between the press roller 22 and the outer surface of the fixing belt 20 by rotational driving of the press roller 22. While the fixing belt 20 slides with its inner surface in tight contact with the lower surface of the sliding member 65 at the fixing nip 27, the fixing belt 20 rotates around the belt guide members 61*a* and 61*b* clockwise as indicated by an arrow at a peripheral speed substantially corresponding to the peripheral rotational speed of the press roller 22. In this case, a lubricant such as a heat-resistant grease can be interposed between the lower surface of the sliding member 65 and the inner surface of the fixing belt 20 at the fixing nip 27 in order to reduce the frictional force of sliding between the lower surface of the sliding member 65 and the inner surface of the fixing belt 20 at the fixing nip 27.

An alternating flux guided to the magnetic cores 62*a*, 62*b*, and 62*c* generates an eddy current in an electromagnetic induction heating layer (not shown) serving as the heating element of the fixing belt 20 between the magnetic cores 62*a* and 62*b* and between the magnetic cores 62*a* and 62*c*. The eddy current generates Joule heat (eddy-current loss) in the electromagnetic induction heating layer by a resistance unique to the electromagnetic induction heating layer inside the fixing belt 20 (to be described later). Letting Q be the maximum heating amount, the heating region is defined as a region having a heating amount of Q/e or more. In this region, a heating amount necessary for fixing can be obtained.

The fixing belt 20 used in the electromagnetic induction heating type fixing unit according to the third embodiment has a multilayered structure of a heating layer (not shown) formed from a metal belt or the like serving as the base layer of the electromagnetic induction heating type fixing belt 20, an elastic layer (not shown) stacked on the outer surface of the heating layer, and a mold release layer (not shown)

stacked on the outer surface of the elastic layer. Primer layers (not shown) may be interposed between the respective layers in order to adhere the heating layer and elastic layer and adhere the elastic layer and mold release layer. The heating layer of the almost cylindrical fixing belt 20 serves as an inner surface, and its mold release layer serves as an outer surface. As described above, an alternating flux acts on the heating layer, an eddy current is generated in the heating layer, and the heating layer generates heat. The heat heats the fixing nip 27 via the elastic layer and mold release layer to heat a print medium P serving as a medium to be heated that passes through the fixing nip 27, thereby heating and fusing a toner image.

The temperature of the fixing belt 20 is so controlled as to be maintained at a predetermined temperature by controlling current supply to the exciting coil 63 by the temperature control systems 21 and 67 including a main thermistor 18 and sub-thermistor 19 serving as a temperature detection unit. The main thermistor 18 is a temperature detection unit which detects the temperature of the fixing belt 20. In the third embodiment, the main thermistor 18 is exposed on the outer surface of the belt guide member 61*a* in a heating region H on the inner surface of the fixing belt 20. The main thermistor 18 contacts the inner surface of the fixing belt 20 to detect the temperature of the fixing belt 20. Temperature information of the fixing belt 20 measured by the main thermistor 18 is input to the controller 21. The controller 21 controls current supply from the power supply portion 67 to the exciting coil 63 on the basis of the input temperature information, and controls the temperature of the fixing belt 20, i.e., the temperature of the fixing nip 27 to a predetermined one.

The fixing belt 20 rotates, power fed from the power supply portion 67 to the exciting coil 63 causes electromagnetic induction heating of the fixing belt 20, and the fixing nip 27 rises to a predetermined temperature. In this temperature-controlled state, a print medium P which is conveyed from the image forming part and bears an unfixed toner image t is introduced between the fixing belt 20 and the press roller 22 at the fixing nip 27 with the image surface facing up, i.e., opposed to the fixing belt surface. The image surface is brought into tight contact with the outer surface of the fixing belt 20 at the fixing nip 27, and the print medium P is clamped and conveyed together with the fixing belt 20 through the fixing nip 27. While the print medium P is clamped and conveyed together with the fixing belt 20 at the fixing nip 27, the unfixed toner image t on the print medium P is heated and fixed by electromagnetic induction heating of the fixing belt 20. After the print medium P passes through the fixing nip 27, it is separated from the outer surface of the fixing belt 20 and discharged. The heated/fused toner image on the print medium is cooled as a permanently fixed image after passing through the fixing nip.

The counting method in this case is the same as that in the first embodiment, and a description thereof will be omitted. Since the configuration of the third embodiment cannot predict the temperature of the press roller 22 by using a temperature detected by the thermistor, the following method is adopted.

In the third embodiment, the counter is subtracted by "0.2" every 10 sec after the intermittent time exceeds 300 sec. This value "0.2" is determined for the fixing unit according to the third embodiment. The count may be obtained by calculation of weighting every elapsed time or selected from a table.

The effects in the use of the third embodiment are the same as those in the first embodiment in principle, and the same effects can be obtained.

As described above, according to the third embodiment, the approximate temperature of the press roller 22 cannot be detected by a thermistor in the use of a fixing unit different from that of the first embodiment. Even in this case, by using the counter for counting up or counting down in accordance with the start-up count of the fixing unit 12, the temperature of the press roller 22 can be predicted at high precision regardless of the use state of the fixing unit, and a control temperature complying with the temperature of the press roller 22 can be selected. An image failure generated at an improper fixing control temperature or winding of a print medium can be prevented. As a result, a high-quality image with good fixation without any nonuniformity of the print quality such as the gloss value can be obtained.

[Fourth Embodiment]

In the fourth embodiment, the present invention can be applied to a fixing unit different from the fixing units described in the first to third embodiments especially in the use of not the press roller 22 but a press unit which is driven to rotate by sliding using a film. Also in this case, the same effects can be obtained.

The fourth embodiment will be explained by using the following fixing unit which is different from the fixing unit described in the first and second embodiments. This fixing unit is a heating fixing unit in which a heating member which contacts the outer surface of a fixing roller to form a heating nip and a press member which press-contacts the fixing roller to form a fixing nip are formed, and a print medium bearing an unfixed toner image is clamped and conveyed to the fixing nip to heat and fix the toner image.

Figure 16:
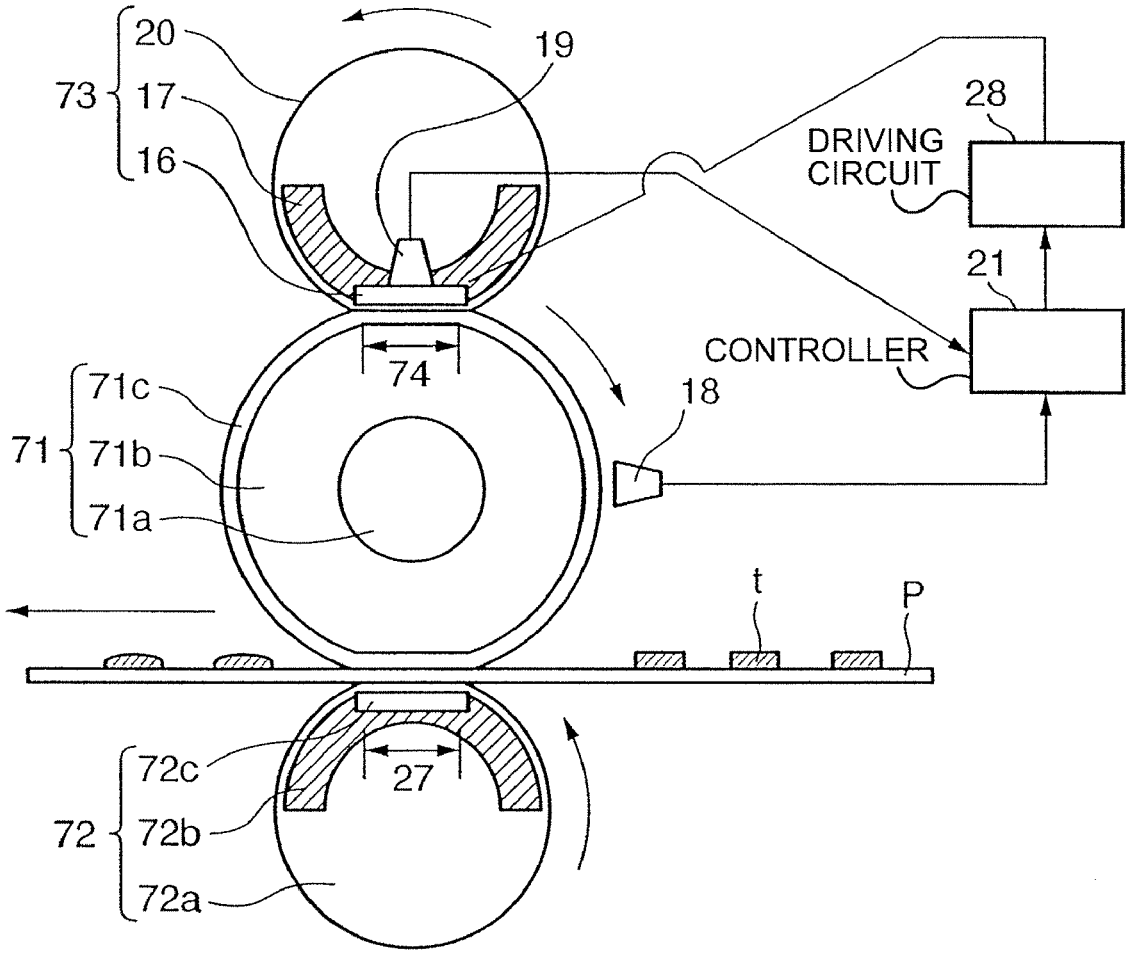
FIG. 16 depicts a schematic view showing the schematic configuration of a fixing unit according to the fourth embodiment of the present invention.

FIG. 16 depicts a schematic view showing the schematic configuration of the fixing unit according to the fourth embodiment of the present invention.

In FIG. 16, a fixing roller 71 is an elastic roller with an outer diameter of 20 mm which is formed from a core 71*a*, a 3-mm thick silicone rubber layer 71*b* covering the outer surface of the core, and a 50-μm thick PFA resin 71*c* covering the outer surface of the silicone rubber layer 71*b*. A surface heating unit 73 serving as a heating member is prepared by freely rotatably fitting an endless belt-like (cylindrical) heating film 20 around a heater holder 17 which supports a ceramic heater 16 serving as a heating element. The heater holder 17 is pressed against the elastic force of the elastic layer 71*b* of the fixing roller 71 to the fixing roller 71. The heater 16 is brought into press contact with the fixing roller 71 via the heating film 20, forming a heating nip 74.

A press unit 72 serving as a press member has a structure similar to that of the surface press unit 73. The press unit 72 is prepared by freely rotatably fitting an endless belt-like (cylindrical) film 72*c* around a sliding plate holder 72*b* which supports a sliding plate 72*a*. The sliding plate holder 72*b* is pressed against the elastic force of the elastic layer 71*b* of the fixing roller 71 to the fixing roller 71. The sliding plate 72*a* is brought into press contact with the fixing roller 71 via the film 72*c*, forming a fixing nip 27.

The heating film 20 is prepared by applying a 10-μm thick PFA resin to the surface of a 40-μm thick PI (polyimide) resin, and the peripheral length of the heating film 20 is 56.5 mm. The ceramic heater 16 has an output of 700 W, and is prepared by printing a resistor on an aluminum layer 8 mm wide and 1 mm thick and protecting the resistor with glass.

The fixing roller 71 is driven to rotate by a driving portion (not shown) clockwise as indicated by an arrow in FIG. 16. Along with rotational driving of the fixing roller 71, the press unit 72 is driven to rotate counterclockwise as indicated by an arrow by friction at the fixing nip 27. The heating film 20 of the surface heating unit 73 is driven to rotate counterclockwise as indicated by an arrow around the heater holder 17 by friction at the heating nip 74 with the inner surface sliding in tight contact with the surface of the heater 16.

The temperature of the ceramic heater 16 serving as the heating unit of the surface heating unit 73 quickly rises upon energization from a power supply portion 28 to the energization heating resistance layer. Heat generated by the fixing heater 16 heats the surface of the rotational fixing roller 71 via the heating film 20 at the heating nip 74.

In the fourth embodiment, a thermistor 18 serving as a temperature detection unit is set on the upstream side of the fixing nip 27 in noncontact with the fixing roller 71. The setting position of the thermistor 18 is so determined as to detect a temperature near the fixing nip 27 at which fixing operation to a print medium P is performed. The reason that the thermistor 18 is set in noncontact with the fixing roller 71 is to prevent toner contamination of the surface of the thermistor 18. A controller 21 which controls the temperature controls the feed state from the power supply portion 28 to the fixing heater 16 on the basis of a temperature detected by the thermistor 18, and controls the temperature so as to maintain the surface temperature of the fixing roller 71 at a predetermined fixing temperature.

The fixing roller 71 is driven to rotate, and the press unit 72 and the heating film 20 of the surface heating unit 73 are driven to rotate along with this. The ceramic heater 16 of the surface heating unit 73 is energized to control the surface temperature of the fixing roller 71 to a predetermined fixing temperature. In this state, a print medium P which bears an unfixed toner image t and is to be heated is introduced to the fixing nip 27 between the fixing roller 71 and the press unit 72. The print medium P is brought into tight contact with the outer surface of the fixing roller 71, and passes through the fixing nip 27 together with the fixing roller 71. While passing through the fixing nip 27, the toner image t is heated and fused by heat conduction from the fixing roller 71. The print medium P having passed through the fixing nip 27 is separated from the outer surface of the fixing roller 71 on the print medium output side of the fixing nip 27, and conveyed.

Since the press unit 72 also has a heat capacity and does not generate heat by itself, the same problems as those described above arise. Even in this case, the present invention can be applied. The effects in the use of the fourth embodiment are the same as those in the first embodiment in principle, and the same effects can be obtained.

As described above, according to the fourth embodiment, not the press roller 22 but the press unit 72 which is driven to rotate by sliding using a film is used is adopted even in the use of a fixing unit different from that of the first and second embodiments. By using a count value of the counter which counts up or down in accordance with the start-up count of the fixing unit, the temperature of the press unit can be predicted at high precision, and a control temperature complying with the temperature of the press unit can be selected. An image failure generated at an improper the fixing control temperature or winding of a print medium can be prevented, and a high-quality image with good fixation without any nonuniformity of the print quality such as the gloss value can be obtained.

[Other Embodiment]

(1) In the first to third embodiments, the process speed is 100 mm/sec in the "plain sheet mode" and 30 mm/sec in the "OHP mode", and the control temperature is set as shown in FIG. 7. However, the present invention can also be applied when the process speed, print speed, and control temperature are changed depending on the type of print medium, the quality of an image to be obtained, or conditions for obtaining more preferable fixation or the like. At this time, a table defining counted-up values and counted-down values changes depending on the process speed and control temperature.

(2) The first and second embodiments have described a fixing unit in which the heat capacity of the fixing belt 20 is at least $4.2\times10^{-2}$ J/cm$^{2}$° C. to 4.2 J/cm$^{2}$° C. This is because when the heat capacity of the fixing belt 20 is $4.2\times10^{-2}$ J/cm$^{2}$° C. or more, the on-demand characteristic of the fixing unit is impaired, and when the heat capacity is 4.2 J/cm$^{2}$° C. or less, the thickness of the elastic layer of the fixing belt 20 cannot be ensured and an image failure such as gloss nonuniformity appears. However, the present invention can be applied to even a fixing unit having a fixing belt with another heat capacity, and can obtain the same effects.

(3) In the first and second embodiments, the heating element need not always be positioned at the fixing nip 27. For example, the heat source can also be positioned on the upstream or downstream side of the fixing nip 27 along the moving direction of the fixing belt 20.

(4) In the first to third embodiments, the fixing unit is of a press rotary body driving type. Alternatively, a driving roller may be arranged on the inner surface of an endless fixing belt to drive the fixing belt while applying a tension to it.

(5) In the fourth embodiment, the fixing unit is of a fixing rotary body driving type. Alternatively, a driving roller may be arranged on the inner surface of an endless heating belt or press belt to drive the heating belt or press belt while applying a tension to it.

(6) The fixing unit according to the embodiments includes not only a fixing unit which heats and fixes an unfixed image as a permanent image onto a print medium, but also an image heating device which temporarily fixes an unfixed image onto a print medium, and an image heating device which heats again a print medium bearing an image to modify an image surface characteristic such as gloss.

(7) In the present invention, the image forming method of the image forming apparatus is not limited to electrophotography, but may be electrostatic printing, magnetic printing, or the like and may also be a transfer type or direct type.

[Other Embodiment]

The present invention may be applied to a system including a plurality of devices (e.g., a host computer, interface device, reader, and printer) or an apparatus (e.g., a copying machine or facsimile apparatus) formed by a single device.

The object of the present invention is also achieved when a storage medium (or recording medium) which stores software program codes for realizing the functions of the above-described embodiments is supplied to a system or apparatus, and the computer (or the CPU or MPU) of the system or apparatus reads out and executes the program codes stored in the storage medium. In this case, the program codes read out from the storage medium realize the functions of the above-described embodiments, and the storage medium which stores the program codes constitutes the present invention. The functions of the above-described embodiments are realized when the computer executes the readout program codes. Also, the functions of the above-described embodiments are realized when an OS (Operating System) or the like running on the computer performs some or all of actual processes on the basis of the instructions of the program codes.

Furthermore, the functions of the above-described embodiments are realized when the program codes read out from the storage medium are written in the memory of a function expansion card inserted into the computer or the memory of a function expansion unit connected to the computer, and the CPU of the function expansion card or function expansion unit performs some or all of actual processes on the basis of the instructions of the program codes. For example, this corresponds to a case in which these processes are executed by a PC deriver.

The present invention is not limited to the above embodiment, and various changes and modifications can be made thereto within the spirit and scope of the present invention. Therefore, to apprise the public of the scope of the present invention, the following claims are made.

CLAIM OF PRIORITY

This application claims priority from Japanese Patent Application No. 2003-395733 filed on Nov. 26, 2003, which is hereby incorporated by reference herein.

What is claimed is:

1. An image forming apparatus having a fixing unit for heating and fixing an image on a print medium, the apparatus, comprising:

a first rotary body arranged in the fixing unit and configured to have a heating source;

a second rotary body configured to clamp a print medium together with said first rotary body;

time interval measurement means for measuring a time interval between activations of the fixing unit;

determination means for determining an update value corresponding to the number of activations of the fixing unit in accordance with the time interval measured by said time interval measurement means;

a counter configured to update a count value on the basis of the update value determined by said determination means; and temperature control means for controlling a temperature of said first rotary body on the basis of the count value updated by update means.

2. The apparatus according to claim 1, wherein said determination means determines a negative value as the update value upon a lapse of more than a predetermined time after stop of heating operation of the fixing unit.

3. The apparatus according to claim 1, further comprising:

temperature detection means for detecting a temperature of the heating source of said first rotary body; and a table configured to store a target temperature value corresponding to the count value, wherein said temperature control means controls the temperature detected by said temperature detection means to the target temperature value corresponding to the count value.

4. The apparatus according to claim 3, wherein in the table, the target temperature value corresponding to the count value changes depending on a type of print medium.

5. The apparatus according to claim 3, wherein said table sets the target temperature value so as to decrease the target temperature value as the count value increases.

6. The apparatus according to claim 1, wherein the count value of the counter corresponds to a temperature of said second rotary body.

7. The apparatus according to claim 1, wherein said temperature control means comprises at least two temperature detection elements arranged near the heating source, at least one of the temperature detection element being arranged near said second rotary body, and in a case where the time interval of the fixing unit that is measured by said time interval measurement means is not less than a predetermined value, said temperature control means performs control on the basis of a temperature value detected by the at least one temperature detection element.

8. A control method for an image forming apparatus having a fixing unit for heating and fixing an image on a print medium, the method, comprising:

a time interval measurement step of measuring a time interval between activations of the fixing unit having a first rotary body with a heating source and a second rotary body for clamping the print medium together with the first rotary body;

a determination step of determining an update value corresponding to the number of activations of the fixing unit in accordance with the time interval measured in the time interval measurement step;

an update step of updating a count value on the basis of the update value determined in said determination step; and a temperature control step of controlling a temperature of the first rotary body on the basis of the count value updated in said update step.

9. The method according to claim 8, wherein in said determination step, a negative value is determined as the update value upon a lapse of more than a predetermined time after stop of heating operation of the fixing unit.

10. The method according to claim 8, further comprising a temperature detection step of detecting a temperature of the heating source of the first rotary body, wherein in said temperature control step, the temperature detected in said temperature detection step is controlled to a target temperature value corresponding to the count value.

11. The method according to claim 10, wherein the target temperature value corresponding to the count value changes depending on a type of print medium.

12. The method according to claim 10, wherein the target temperature value is so set as to decrease as the count value increases.

13. The method according to claim 8, wherein the count value corresponds to a temperature of the second rotary body.

14. The method according to claim 8, further comprising a temperature detection step, wherein temperature information detected by at least two temperature detection elements arranged near the heating source are used, and at least one of the temperature detection elements is arranged near the second rotary body, and wherein in said temperature control step, in a case where the time interval of activations of the fixing unit that is measured in said time interval measurement step is not less than a predetermined value, control is performed on the basis of a temperature value detected by the at least one temperature detection element.

* * * * *

UNITED STATES PATENT AND TRADEMARK OFFICE

CERTIFICATE OF CORRECTION

PATENT NO. : 7,190,915 B2
APPLICATION NO. : 10/994297
DATED : March 13, 2007
INVENTOR(S) : Tomoo Akizuki et al.

It is certified that error appears in the above-identified patent and that said Letters Patent is hereby corrected as shown below:

ON THE TITLE PAGE:
At Item (56), References Cited, Foreign Patent Document, "JP 04146452 A * 5/1992" should read --JP 4-146452 A * 5/1992--, and "JP 05307341 A * 11/1993" should read --JP 5-307341 A * 11/1993--.

COLUMN 1:
Line 20, "time)" should read --time) is--.

COLUMN 3:
Line 26, "hot" should read --heat--.

COLUMN 5:
Line 39, "hot" should read --heat--.
Line 55, "with" should be deleted.
Line 57, "apparatus," should read --apparatus--.

COLUMN 6:
Line 5, "with" should be deleted.
Line 7, "method," should read --method--.

COLUMN 9:
Line 46, "sleeve" should read --sleeve-like--.
Line 57, "fitted outer" should read --fitted on--.

COLUMN 10:
Line 20, "sub" should read --sub,--.

COLUMN 14:
Line 31, "$8.8 \times 10^{-2}$ 2J/Cm$^2$°C." should read --$8.8 \times 10^{-2}$ J/Cm$^2$°C.--.

COLUMN 15:
Line 6, "counted-up" should read --counted-up value--.

UNITED STATES PATENT AND TRADEMARK OFFICE

CERTIFICATE OF CORRECTION

PATENT NO. : 7,190,915 B2
APPLICATION NO. : 10/994297
DATED : March 13, 2007
INVENTOR(S) : Tomoo Akizuki et al.

It is certified that error appears in the above-identified patent and that said Letters Patent is hereby corrected as shown below:

COLUMN 16:
Line 15, “in almost” should read --almost in--.

COLUMN 17:
Line 24, “hot” should read --heat--.
Line 37, “750” should read --75°--.
Line 46, “mm-solid” should read --mm solid--.

COLUMN 18:
Line 28, “hot” should read --heat--.

COLUMN 19:
Line 25, “hot” should read --heat--.

COLUMN 20:
Line 9, “describe” should read --described--.

COLUMN 22:
Line 15, “fitted outer” should read --fitted in--.

COLUMN 25:
Line 43, “is used is” should be deleted.--.

COLUMN 26:
Line 65, “deriver.” should read --driver.--.
Line 67, “ment,” should read --ments,--.

UNITED STATES PATENT AND TRADEMARK OFFICE

CERTIFICATE OF CORRECTION

PATENT NO. : 7,190,915 B2
APPLICATION NO. : 10/994297
DATED : March 13, 2007
INVENTOR(S) : Tomoo Akizuki et al.

It is certified that error appears in the above-identified patent and that said Letters Patent is hereby corrected as shown below:

COLUMN 27:
Line 12, "ratus," should read --ratus--.
Line 55, "element" should read --elements--.

COLUMN 28:
Line 7, "method," should read --method--.

Signed and Sealed this

Sixth Day of May, 2008

JON W. DUDAS
*Director of the United States Patent and Trademark Office*